US006994953B2

(12) United States Patent
Matsuda et al.

(10) Patent No.: US 6,994,953 B2
(45) Date of Patent: Feb. 7, 2006

(54) SILVER HALIDE PHOTOSENSITIVE MATERIAL

(75) Inventors: Naoto Matsuda, Minami-Ashigara (JP); Yasushi Miyamoto, Minami-Ashigara (JP); Tomokazu Yasuda, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/921,963

(22) Filed: Aug. 20, 2004

(65) Prior Publication Data

US 2005/0042557 A1 Feb. 24, 2005

(30) Foreign Application Priority Data

Aug. 22, 2003 (JP) ..... 2003-298541

(51) Int. Cl.
*G03C 1/005* (2006.01)
*G03C 1/494* (2006.01)

(52) U.S. Cl. ..... 430/631; 430/567; 430/634; 430/635; 430/570; 430/546; 430/502

(58) Field of Classification Search ..... 430/567, 430/631, 634, 635, 570, 546, 502
See application file for complete search history.

(56) References Cited

FOREIGN PATENT DOCUMENTS

| | | |
|---|---|---|
| EP | 0182658 A2 | 5/1986 |
| JP | 61-184542 | 8/1986 |
| JP | 480751 | 3/1992 |

*Primary Examiner*—Geraldine Letscher
(74) *Attorney, Agent, or Firm*—Sughrue Mion, PLLC

(57) ABSTRACT

A silver halide photosensitive material comprises a light-sensitive silver halide emulsion layer on a support. The photosensitive material has a layer comprising an emulsified dispersion containing a surfactant represented by formula (I), and an emulsion containing tabular silver halide grains having an average aspect ratio of 8 or greater, and at least one sensitizing dye.

$(R_1\text{-}L)_n\text{-}J\text{-}(A)_m$ General formula (I)

wherein A represents an acid group or a metal salt thereof, $R_1$ represents an aliphatic group containing a linear aliphatic group having 6 or more carbon atoms as a partial structure thereof and having the total number of carbon atoms of 17 or more, L represents a bivalent group, J represents a linking group of n+m valence, n is an integer of 1 to 6, and m is an integer of 1 to 3. The molecular weight of surfactant of the formula (I) divided by m is 430 or greater.

18 Claims, No Drawings

SILVER HALIDE PHOTOSENSITIVE MATERIAL

CROSS-REFERENCE TO RELATED APPLICATIONS

This application is based upon and claims the benefit of priority from prior Japanese Patent Application No. 2003-298541, filed Aug. 22, 2003, the entire contents of which are incorporated herein by reference.

BACKGROUND OF THE INVENTION

1. Field of the Invention

The present invention relates to a silver halide photosensitive material.

2. Description of the Related Art

In silver halide color photosensitive materials, sensitizing dyes are added to photo-sensitive silver halide emulsion grains so as to effect spectral sensitization in desired wavelength regions of blue, green and red, optionally including infrared.

The thus added sensitizing dyes are ordinarily unnecessary in images after development processing, and it is preferred under normal conditions that the whole amount of sensitizing dyes flow out from the photosensitive material or be decolorized during the development processing. However, in actual color photosensitive materials, portions of the sensitizing dyes occasionally do remain even after the development processing.

When the remaining of sensitizing dyes occurs in, for example, color reversal film photosensitive materials, coloring is likely to be conspicuous in white background areas of images. Thus, in color film designing, it is preferred to suppress the remaining of sensitizing dyes.

On the other hand, in color films of recent years, measures comprising using silver halide emulsion grains in tabular form so as to achieve an increase of surface area and loading the increased surface with a large amount of sensitizing dyes so as to attain a sensitivity enhancement, are increasingly employed. These measures naturally increase the amount of sensitizing dyes remaining after the development processing, thereby deteriorating the quality of color film. Therefore, there is a demand for a technique capable of reducing the amount of remaining sensitizing dyes. Such a technique capable of reducing the amount of remaining sensitizing dyes has become especially important in the recent technical trend comprising increasing the aspect ratio of tabular silver halide grains as a source for sensitivity enhancement.

BRIEF SUMMARY OF THE INVENTION

The inventors have conducted extensive and intensive studies with respect to the residue of sensitizing dyes in color films. As a result, it has been found that the residual amount of sensitizing dyes can be reduced by the use of specified surfactants at the emulsification dispersion of photographically useful materials such as image forming couplers.

With respect to surfactants, although examples of the effects thereof on the enhancement of image fastness (see, for example, Jpn. Pat. Appln. KOKAI Publication No. (hereinafter referred to as JP-A-) 61-184542) and examples of the effects thereof on the enhancement of color formation capability and image fastness (see, for example, JP-A-4-80751) have been disclosed, the effect thereof on the residue of sensitizing dyes has been unknown.

It is a primary object of the present invention to provide a method of reducing the amount of sensitizing dyes remaining after the development processing in the field of silver halide photosensitive materials. It is a further object of the present invention to provide a silver halide photosensitive material of high speed that ensures less coloring in white background areas of images, realizing excellent storability especially in heat and humidity.

The objects of the present invention have been attained by the following.

(1) A silver halide photosensitive material comprising at least one light-sensitive silver halide emulsion layer on a support, wherein the silver halide photosensitive material has at least one layer comprising an emulsified dispersion containing at least one surfactant represented by the following general formula (I), and at least one emulsion containing tabular silver halide grains having an average aspect ratio of 8 or greater, and at least one sensitizing dye.

$$(R_1\text{-}L)_n\text{-}J\text{-}(A)_m \qquad \text{General formula (I)}$$

In the formula, A represents an acid group selected from sulfonic acid, phosphoric acid and carboxylic acid groups, or a metal salt thereof. $R_1$ represents an aliphatic group containing a straight-chain aliphatic group having 6 or more carbon atoms as a partial structure thereof. L represents a bivalent group. J represents a linking group of n+m valence which links $R_1$-L with A. n is an integer of 1 to 6, and m is an integer of 1 to 3. When n is 2 or greater, the plurality of $R_1$-L's may be the same or different. When m is 2 or greater, the plurality of A's may be the same or different. Provided that the total number of carbon atoms of $R_1$ (when n is 2 or greater, the total number of carbon atoms of all the $R_1$'s) is 17 or greater, and that the quotient of the molecular weight of surfactant of the general formula (I) (with respect to a salt of metal atom, molecular weight after substitution with hydrogen atom) divided by m is 430 or greater.

(2) A silver halide photosensitive material comprising at least one light-sensitive silver halide emulsion layer on a support, wherein the silver halide photosensitive material has at least one layer comprising an emulsified dispersion containing a surfactant represented by the following general formula (I), and at least one emulsion containing tabular silver halide grains having an average equivalent sphere diameter of 0.55 $\mu$m or less and having an average aspect ratio of 2 or greater, and at least one sensitizing dye.

$$(R_1\text{-}L)_n\text{-}J\text{-}(A)_m \qquad \text{General formula (I)}$$

wherein A, $R_1$, L J, m and n are as defined in (1) above.

(3) A silver halide photosensitive material comprising at least one light-sensitive silver halide emulsion layer on a support, wherein the silver halide photosensitive material has at least one layer comprising an emulsified dispersion containing a surfactant represented by the following general formula (I), and the total amount of spectral sensitizing dyes contained in the silver halide photosensitive material is in the range of 18 to 200 mg/m$^2$.

$$(R_1\text{-}L)_n\text{-}J\text{-}(A)_m \qquad \text{General formula (I)}$$

wherein A, $R_1$, L J, m and n are as defined in (1) above.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The surfactants represented by the general formula (I) will be described in detail below.

First, A of the general formula (I) will be described. A represents an acid group selected from sulfonic acid, phosphoric acid and carboxylic acid groups, or a metal salt thereof. Preferably, A represents a sulfonic acid or phosphoric acid group. More preferably, at least one of A's represents a sulfonic acid group or a metal salt thereof. When a metal salt is represented, the metal atom is preferably an alkali metal (e.g., lithium, sodium or potassium) or an alkaline earth metal (e.g., magnesium or calcium). Most preferably, the metal atom is lithium, sodium or potassium. The bonding between A and J is effected at a carbon atom when A is a carboxylic acid. When A represents sulfonic acid or phosphoric acid, the bonding may be effected at a sulfur atom or phosphorus atom, or may be effected via an oxygen atom.

$R_1$ represents an aliphatic group containing a linear aliphatic group having 6 or more carbon atoms as a partial structure thereof. The above linear aliphatic group having 6 or more carbon atoms may be, for example, a saturated linear alkyl group such as n-octyl or n-dodecyl, or may be a linear group having in its molecule an unsaturated bond (the position thereof is not particularly limited, and when the unsaturated bond is a double bond, its arrangement may be cis or trans) such as oleyl, or may be a branched alkyl group such as 2-n-hexyl-n-nonyl. The group $R_1$ per se may be a linear aliphatic group having 6 or more carbon atoms. The hydrogen atoms of such aliphatic groups may partially or entirely be substituted with halogen atoms (e.g., fluorine atom or chlorine atom). A bivalent group such as oxygen atom may be inserted in the middle thereof. Further, $R_1$ may be in the form of a polymer comprising, via J, the general formula (I) as a constituting unit.

Among them, $R_1$ is preferably an aliphatic group containing an aliphatic group having 9 or more carbon atoms as a partial structure thereof, more preferably an aliphatic group containing an aliphatic group having 12 or more carbon atoms as a partial structure thereof.

Specific examples of these groups include:

n-$C_8H_{17}$, n-$C_9H_{19}$, n-$C_{10}H_{21}$, n-$C_{12}H_{25}$, n-$C_{14}H_{29}$, n-$C_{16}H_{33}$, n-$C_{18}H_{37}$, n-$C_{20}H_{41}$, 2-ethylhexyl, i-$C_{16}H_{33}$, n-$C_{18}H_{35}$ (one double bond contained in the alkyl chain), $CH_3$—$(CF_2)_4$—$(CH_2)_4$, $CH_3$—$(CF_2)_8$ and $C_{12}H_{25}$—$OC_2H_4$—.

L represents a bivalent group. As the same, there can be mentioned, for example, —$CHR_2$—, —O—, —CO— (bonding may be effected in either direction), —COO— (bonding may be effected in either direction), —OCOO—, —$CONR_2$— (bonding may be effected in either direction), —$NR_2CONR_3$—, —$SO_2$—, —$SO_2NR_2$— (bonding may be effected in either direction), —S—, or substituted or unsubstituted phenylene or naphthalene group. Each of $R_2$ and $R_3$ represents a hydrogen atom or an alkyl.

Among these, L preferably represents —$CHR_2$—, —O—, —CO— (bonding may be effected in either direction), —COO— (bonding may be effected in either direction) or —$CONR_2$— (bonding may be effected in either direction).

J represents a linking group. J is not limited as long as it is a group capable of linking L with A. Examples of the linking forms between L, J and A are as follows.

(J-1)

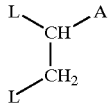

(J-2)

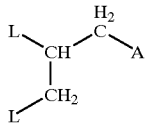

(J-3)

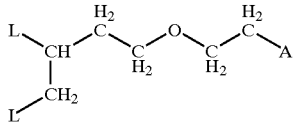

(J-4)

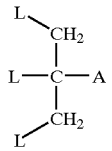

(J-5)

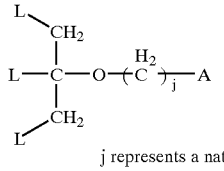

j represents a natural number of 1 to 10.

(J-6)

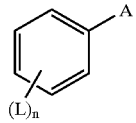

(J-7)

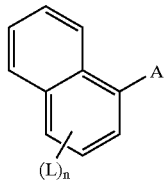

(J-8)

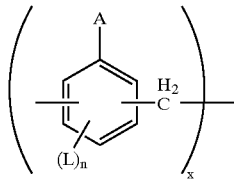

x represents a natural number of 10 or greater.

(J-9)

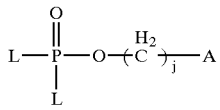

-continued (J-10)

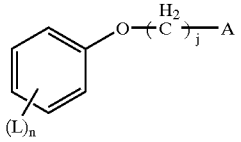

n is an integer of 1 to 6, preferably 2 to 6.

m is an integer of 1 to 3, preferably 1.

In the surfactants of the general formula (I), the total number of carbon atoms of $R_1$ is 17 or greater, preferably in the range of 20 to 70, and more preferably in the range of 24 to 50.

The quotient of the molecular weight of surfactant of the general formula (I) divided by m is 430 or greater, preferably in the range of 450 to 1000, and more preferably in the range of 470 to 900.

Among the surfactants of the general formula (I), the compounds of the following general formula (II) are preferred.

$(R_1\text{-}L_2\text{-})_k J\text{-}SO_3M$ General formula (II)

In this formula, $R_1$ is as defined in the general formula (I). $L_2$ represents a bivalent group selected from —O—, —CO— and —O—CO— (bonded with $R_1$ at the left side of the formula). k is 2 or 3. J represents a linking group of k+1 valence, provided that the J group does not contain any aryl group. M represents a hydrogen atom or a metal atom. Provided that the total number of carbon atoms of $R_1$ in the moiety of $(R_1\text{-}L_2)_k$ is 17 or greater, and that the molecular weight of each of the compounds of the general formula (II) (assuming that M is a hydrogen atom) is 430 or greater.

In the general formula (II), $R_1$ is preferably a saturated or unsaturated linear or branched aliphatic group containing at least a linear chain moiety having 9 or more carbon atoms as a partial structure thereof, more preferably a saturated or unsaturated linear or branched aliphatic group containing at least a linear chain moiety having 12 or more carbon atoms as a partial structure thereof. The hydrogen atoms of these may partially be substituted with halogen atoms.

The total number of carbon atoms of $R_1$ is 17 or greater, preferably 20 or greater and more preferably 24 or greater.

$L_2$ represents a bivalent group selected from —O—, —CO— and —O—CO— (bonded with $R_1$ at the left side of the formula). $L_2$ preferably represents —O— or —O—CO— (bonded with $R_1$ at the left side of the formula), most preferably —O—CO— (bonded with $R_1$ at the left side of the formula).

J represents a linking group which does not contain any aryl group. J is preferably an alkylene having 10 or less carbon atoms, or a bivalent group constituted of an alkylene having 10 or less carbon atoms and an oxygen atom (ether group) (the oxygen atom may be positioned in the middle of alkylene or at ends thereof), or the group (J-9) mentioned in the description of J of the general formula (I). More preferably, J is an alkylene having 8 or less carbon atoms, or a bivalent group constituted of an alkylene having 8 or less carbon atoms and an oxygen atom (the oxygen atom may be positioned in the middle of alkylene or at ends thereof), or the group (J-9). In the (J-5) and (J-9) among the (J-1), (J-2), (J-3), (J-4), (J-5) and (J-9) mentioned in the description of the general formula (I), j is most preferably 6 or less.

k is 2 or 3, preferably 2.

As other preferred examples of the surfactants represented by the general formula (I), there can be mentioned those of the following general formulae (III) and (IV).

General formula (III)

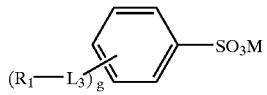

General formula (IV)

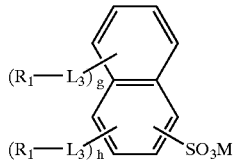

In the general formulae (III) and (IV), $R_1$ is as defined in the general formula (I), and preferred examples thereof are the same as mentioned there.

$L_3$ represents a bivalent group selected from $—CHR_2—$, —O—, —CO—, —COO— (bonding may be effected in either direction), —OCOO—, $—CONR_2—$ (bonding may be effected in either direction), $—NR_2CONR_3—$, $—SO_2—$, $—SO_2NR_2—$ (bonding may be effected in either direction) and —S—. $R_2$ and $R_3$ are as defined in the general formula (I).

g is a natural number of 1 to 4, and h is a natural number of 1 to 3.

The compounds of the general formulae (III) and (IV) will be described in detail below.

$L_3$ preferably represents $—CHR_2—$, —O—, —CO—, —COO—, $—CONR_2—$ (bonding may be effected in either direction) or $—SO_2NR_2—$ (bonding may be effected in either direction), and more preferably represents $—CHR_2—$, —O—, —COO— (bonding may be effected in either direction) or $—CONR_2—$ (bonding may be effected in either direction).

Each of g and h is preferably 1 or 2. More preferably, g is 2, or g and h are simultaneously 1.

In the present invention, most preferred surfactants are those of the general formula (II) wherein $R_1$ is an aliphatic group containing a linear chain moiety having 9 or more carbon atoms, the aliphatic group having 10 to 20 carbon atoms in total; $L_2$ is —O— or —OOC— (bonded with $R_1$ at the oxygen atom); J is an alkylene having 2 to 10 carbon atoms, or a bivalent group constituted of an alkylene having 2 to 10 carbon atoms and an oxygen atom; and k is 2 or 3.

Specific examples of the compounds of the general formula (I) will be shown below, which however in no way limit the scope of the present invention.

K-1

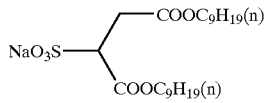

K-2

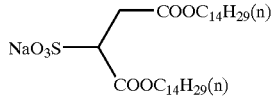

K-3

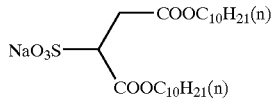

-continued
K-4
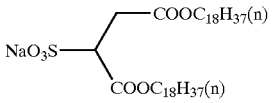
K-5
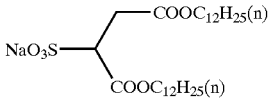
K-6
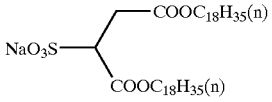
K-7
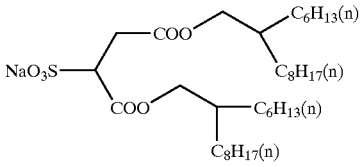
K-8
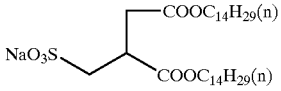
K-9
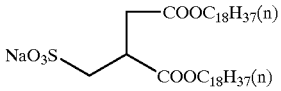
K-10
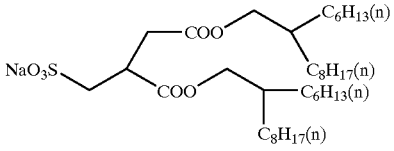
K-11
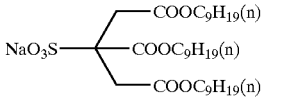
K-12
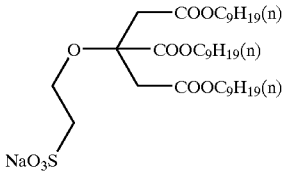
K-13
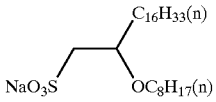
K-14
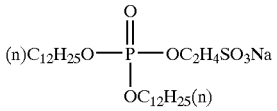
K-15
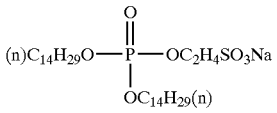
-continued
K-16
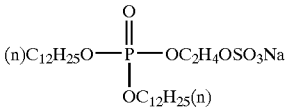
K-17
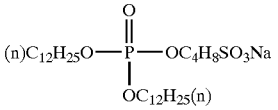
K-18
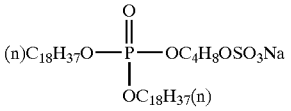
K-19
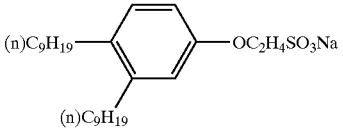
K-20
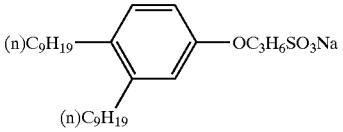
K-21
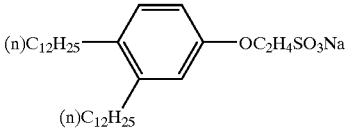
K-22
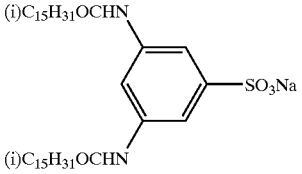
K-23
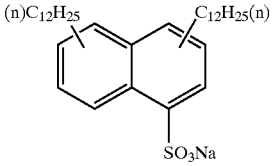
K-24
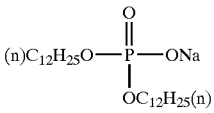
K-25
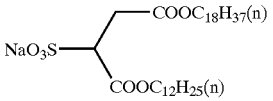
K-26
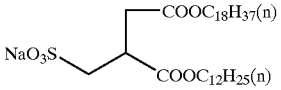
K-27
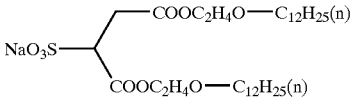

-continued

K-28

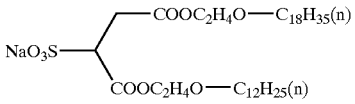

K-29

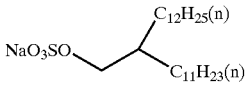

K-30

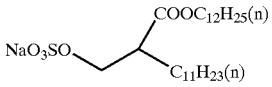

K-31

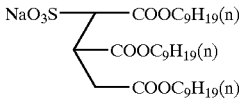

K-32

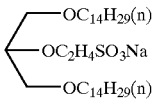

K-33

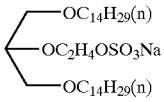

K-34

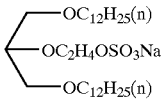

K-35

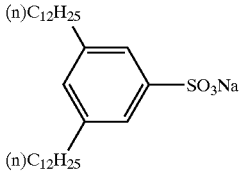

K-36

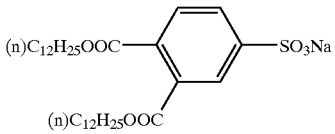

K-37

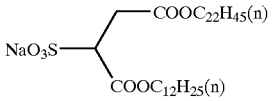

K-38

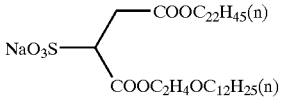

The method of adding the surfactant of the present invention to a photosensitive material may be any one, and preferably, the surfactant may be added at the time of dissolving photographically useful oil-soluble compounds, such as a coupler, color-mixing preventing agent and ultraviolet absorbent, and dispersing it by emulsification to an aqueous solution.

The addition amount of the surfactant of the present invention is preferably 0.01 g to 1.0 g, more preferably 0.05 g to 0.5 g per square meter of the photosensitive material. Further, when the surfactant of the present invention is used for emulsifying dispersion, the amount is preferably 1 to 20% by weight, more preferably 1 to 10% by weight to the total weight of the oil-soluble compounds contained in the emulsified dispersion.

The surfactant of the present invention may be used in combination with another surfactant. Preferably used surfactants to be used in combination are those mentioned below, but the surfactants that may be used in combination with the surfactant of the present invention are not limited to these.

(W-1)

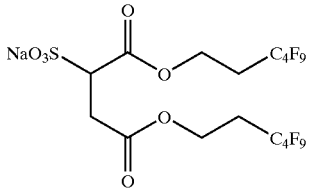

(W-2)

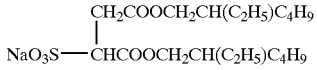

(W-3)

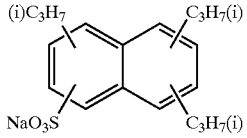

(W-4)

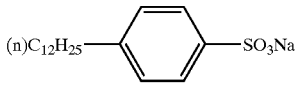

(W-5)

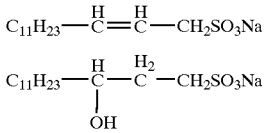

(A 60:40 mixture)

(W-6)

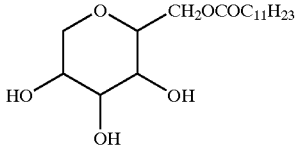

When the surfactant of the present invention is used in combination with other surfactants, the ratio by weight of the surfactant of the present invention to the total amount of surfactants contained in the photosensitive material is preferably 20% or greater, more preferably 40% or greater.

When photographically useful oil-soluble compounds are emulsified and dispersed with the use of the surfactant of the present invention, use can be made of a high-boiling organic solvent.

Examples of the high-boiling organic solvents which can be employed include phthalic acid esters (e.g., dibutyl phthalate, dioctyl phthalate, dicyclohexyl phthalate, di-2-ethylhexyl phthalate, decyl phthalate, bis(2,4-di-tert-amylphenyl) isophthalate and bis(1,1-diethylpropyl) phthalate), esters of phosphoric acid or phosphonic acid (e.g., diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridodecyl phosphate and di-2-ethylhexyl phenyl phosphate), benzoic acid esters (e.g., 2-ethylhexyl benzoate, 2,4-dichlorobenzoate, dodecyl benzoate and 2-ethylhexyl p-hydroxybenzoate), amides (e.g., N,N-diethyldodecanamide, N,N-diethyllaurylamide, N,N,N,N-tetrakis(2-ethylhexyl)isophthalamide, N,N,N,N-tetrakiscyclohexylisophthalamide and o-hexadecyloxybenzamide), high-boiling organic solvents described in, for example, JP-A's-2000-29159, 2001-281821, 2002-40606 and 8-110624, alcohols (e.g., isostearyl alcohol and oleyl alcohol), aliphatic esters (e.g., dibutoxyethyl succinate, di-2-ethylhexyl succinate, 2-hexyldecyl tetradecanoate, tributyl citrate, diethyl azelate, isostearyl lactate and trioctyl citrate), aniline derivatives (e.g., N,N-dibutyl-2-butoxy-5-tert-octylaniline), chlorinated paraffins (paraffins of 10 to 80% chlorine content), trimesic acid esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol and 4-(4-dodecyloxyphenylsulfonyl)phenol), carboxylic acids (e.g., 2-(2,4-di-tert-amylphenoxy)butyric acid and 2-ethoxyoctanedecanoic acid) and alkylphosphoric acids (e.g., di(2-ethylhexyl)phosphoric acid and diphenylphosphoric acid).

Besides these high-boiling solvents, it is also preferred to use compounds described in JP-A-6-258803 as high-boiling solvents.

Further, with respect to a latex dispersing method as one of polymer dispersing methods, the process, effects and examples of immersion latexes are described in, for example, United States Patent No. (hereinafter referred to as U.S. Pat. No. 4,199,363, DE (OLS) U.S. Pat. Nos. 2,541,274 and 2,541,230, Japanese Patent KOKOKU Publication No. (hereinafter referred to as JP-B-) 53-41091 and European Patent Publication No. (hereinafter referred to as EP) 029104 A. Moreover, a dispersion by organic solvent soluble polymers is described in the pamphlet of PCT Publication WO 88/00723.

Still further, as an auxiliary solvent, an organic solvent having a boiling point of 30 to about 160° C. (e.g., ethyl acetate, butyl acetate, ethyl propionate, methyl ethyl ketone, cyclohexanone, 2-ethoxyethyl acetate, dimethylformamide, methanol or ethanol) may be used in combination therewith.

The tabular silver halide grains for use in the present invention will be described.

The silver halide photosensitive material of the present invention is characterized by including at least one silver halide emulsion containing tabular grains having an average equivalent sphere diameter of 0.55 μm or less and having an average aspect ratio of 2 or greater, and/or at least one emulsion containing tabular silver halide grains having an average aspect ratio of 8 or greater.

In the emulsion containing tabular silver halide grains having an average aspect ratio of 8 or greater, the equivalent sphere diameter of grains thereof, although not particularly limited, is preferably in the range of 0.1 to 3.0 μm, more preferably 0.15 to 2.0 μm. The aspect ratio thereof is preferably 10 or greater, more preferably 15 or greater. The aspect ratio is preferably in the range of 10 to 200, more preferably 15 to 200.

In the emulsion containing tabular silver halide grains having an average equivalent sphere diameter of 0.55 μm or less and having an average aspect ratio of 2 or greater, it is preferred that grains having an average equivalent sphere diameter of 0.55 μm or less and having an average aspect ratio of 3 or greater (especially 4 or greater) be contained. It is more preferred that grains having an average equivalent sphere diameter of 0.5 μm or less and having an average aspect ratio of 3 or greater (especially 4 or greater) be contained therein. The average equivalent sphere diameter is preferably 0.20 μm or greater.

The tabular silver halide grains of the present invention, although may comprise any type of silver halides, are preferably constituted of silver iodobromide or silver iodochlorobromide. More preferably, the tabular silver halide grains are constituted of silver iodobromide or silver iodochlorobromide wherein silver iodide is contained in a ratio of 0.5 to 20 mol %.

It is preferred that the variation coefficient of intergranular silver iodide content distribution be 20% or less. The variation coefficient is more preferably 15% or less, most preferably 10% or less. When the variation coefficient is greater than 20%, unfavorably, hard gradation cannot be attained and sensitivity drop upon pressure application is large. The silver iodide content of each individual grain can be measured by analyzing the composition of each individual grain by means of an X-ray microanalyzer. The terminology "variation coefficient of intergranular silver iodide content distribution" means a value defined by the formula:

$$\text{variation coefficient}=(\text{standard deviation}/\text{av. silver iodide content})\times 100$$

wherein the standard deviation of silver iodide content and the average silver iodide content are obtained by measuring the silver iodide contents of at least 100, preferably at least 200, and most preferably at least 300 emulsion grains. The measuring of the silver iodide content of each individual grain is described in, for example, EP 147,868. There are cases in which a correlation exists between the silver iodide content Yi (mol %) of each individual grain and the equivalent sphere diameter Xi (μm) of each individual grain and cases in which no such correlation exists. It is preferred that no correlation exist therebetween.

The silver halide emulsion of the present invention may have a multiple structure with respect to the intragranular halogen composition. For example, it may have a quintuple structure. Herein, the structure refers to having a structure with respect to the distribution of silver iodide and means that the silver iodide contents differ between individual structures in an amount of 1 mol % or more. The structures with respect to the distribution of silver iodide can fundamentally be determined by calculation from recipe values for the step of grain preparation. The change of silver iodide content at each interface of individual structures can be sharp or gentle. In the ascertainment thereof, although an analytical measuring precision must be considered, the EPMA (Electron Probe Micro Analyzer) method is generally effective. In this method, a sample wherein emulsion grains are dispersed so as to avoid contacting thereof with each other is prepared. The sample is irradiated with electron beams to thereby emit X-rays. Analysis of the X-rays enables performing an elemental analysis of an extremely minute region irradiated with electron beams. The measuring is preferably performed while cooling the sample in order to prevent the damaging of the sample by electron beams. This method enables analyzing the intragranular silver iodide distribution exhibited upon viewing the tabular grains in the direction perpendicular to the main surface thereof. Further, by using a specimen obtained by hardening the above sample and slicing the hardened sample with the use of a microtome into extremely thin sections, the method also enables analyzing the intragranular silver iodide distribution across the tabular grain section.

The tabular silver halide grains collectively refer to silver halide grains having one twin plane, or two or more mutually parallel twin planes. The twin plane refers to a (111) face on both sides of which the ions of all the lattice points are in the relationship of reflected images. The tabular grains are each formed by two mutually parallel main surfaces and sides joining these main surfaces to each other. When the tabular grains are viewed from above with respect to the main surfaces, the main surfaces have a triangular or hexagonal shape, or a circular shape corresponding to rounded form thereof. The triangular, hexagonal and circular tabular grains have triangular, hexagonal and circular mutually parallel main surfaces, respectively.

The aspect ratio of tabular grains refers to the quotient of grain diameter divided by grain thickness. The grain thickness can be easily determined by performing a vapor deposition of metal on grains, together with reference latex, in an oblique direction thereof, measuring the length of grain shadow on an electron micrograph and calculating with reference to the length of latex shadow. The grain diameter refers to the diameter of a circle having an area equal to the projected area of mutually parallel main surfaces of grain. The projected area of grains can be obtained by measuring the grain area on an electron micrograph and effecting a magnification correction thereto.

Supplemental addition of gelatin may be effected during the grain formation in order to obtain monodisperse tabular grains of high aspect ratio. The supplemental gelatin is preferably a chemically modified gelatin as described in JP-A's-10-148897 and 11-143002, or a gelatin of low methionine content as described in U.S. Pat. Nos. 4,713,320 and 4,942,120. In particular, the former chemically modified gelatin is a gelatin characterized in that at least two carboxyl groups have newly been introduced at a chemical modification of amino groups contained in the gelatin. Gelatin succinate or gelatin trimellitate is preferably used. The chemically modified gelatin is preferably added prior to the growth step, more preferably immediately after the nucleation. The suitable addition amount thereof is 50% or more, preferably 70% or more, based on the total weight of dispersion medium provided during grain formation.

Examples of silver halide solvents which can be used in the present invention include organic thioethers (a) described in U.S. Pat. Nos. 3,271,157, 3,531,286 and 3,574,628 and JP-A's-54-1019 and 54-158917; thiourea derivatives (b) described in JP-A's-53-82408, 55-77737 and 55-2982; silver halide solvents having a thiocarbonyl group interposed between an oxygen or sulfur atom and a nitrogen atom (c) described in JP-A-53-144319; and, as described in JP-A-54-100717, imidazoles (d), sulfites (e), ammonia (f) and thiocyanates (g). Especially preferred silver halide solvents are thiocyanates, ammonia and tetramethylthiourea. Although the amount of added silver halide solvent depends on the type thereof, in the case of, for example, a thiocyanate, the preferred addition amount is in the range of $1\times10^{-4}$ to $1\times10^{-2}$ mol per mol of silver halides.

As one preferable embodiment for tabular grains of the present invention, tabular grains each having a dislocation line can be mentioned.

Firstly, tabular grains having a dislocation line will be described.

The dislocation line of the tabular grain can be observed by a direct method using a transmission electron microscope at a low temperature described, for example, in above mentioned J. F. Hamilton, Phot. Sci. Eng., 11, 57 (1967) or Shiozawa, J. Soc. Phot. Sci. Japan. 35, 213 (1972). That is, silver halide grains are taken out of an emulsion with taking care not to give a strong pressure which may induce dislocation to the grains, placed on the mesh for electron microscope observation and observed by a transmission method while cooling the sample in order to avoid damage by electron beams (print our or the like). In this case, since thicker thickness of the grain makes the electron beam more difficult to transmit, use of a high voltage type (acceleration voltage of 200 kV or higher for grains with thickness of 0.25 $\mu$m) electron microscope can make a more clear observation possible. Using the photograph of the grain obtained by the method, position of the dislocation line seen from the perpendicular direction to the main plain can be obtained.

As for position of the dislocation line of the tabular grain used in the invention, it starts from the distance of x % of the length between the center and the edge to the edge, in relation to the long axis direction. The value of x is preferably $10\leqq x<100$, more preferably $30\leqq x<98$, and further more preferably $50\leqq x<95$. On this occasion, figure that is formed by binding the position where the dislocation lines start is nearly analogous to the figure of the grain, however sometimes it twists to become not completely analogous. Direction of the dislocation line is approximately the direction from the center to the edge. But it often meanders.

As for number of the dislocation lines of the tabular grains used in the invention, presence of grains having 10 dislocation lines or more by 50% (number of pieces) or more is preferable. More preferably the tabular grains including grains having 10 dislocation lines or more by 80% (number of pieces) or more, and particularly preferably those including grains having 20 dislocation lines or more by 80% (number of pieces) or more, are recommended.

When the silver halide grains of the present invention are tabular grains having dislocation lines, the aspect ratio thereof is preferably 2 or more, more preferably 3 or more, and most preferably 4 to 20.

Dislocation of the tabular grain used in the invention is introduced by providing a high-iodide phase inside the grain. The high-iodine phase means a silver halide solid solution containing iodine. As silver halide in this case, silver iodide, silver iodobromide or silver chloroiodobromide is preferable, silver iodide or silver iodobromide is more preferable, and silver iodide is particularly preferable.

Amount of silver halide forming the high-iodide phase is, in terms of silver, 30 mol % or less, and more preferably 10 mol % or less of the total amount of silver in the grains.

A layer to be grown outside the high-iodide phase need contain a less content of iodide than that in the high-iodide phase. Preferably the iodide content is 0 to 12 mol %, more preferably 0 to 6 mol %, and most preferably 0 to 3 mol %.

As the preferable method for forming the high-iodide phase, there is a method in which it is formed by adding an emulsion containing fine grains of silver iodobromide or silver iodide. As these fine grains, those that have been previously prepared can be used and, more preferably, those that have been just prepared can be also used.

Firstly, the case, in which previously prepared fine grains are used, will be described. In this case, there is a method such that previously prepared fine grains are added and ripped to be dissolved. As a more preferable method, there is a method such that the silver iodide fine grain emulsion is added and then a silver nitrate aqueous solution, or a silver nitrate aqueous solution and halide aqueous solution are added. In this case, dissolution of the silver iodide fine grains is accelerated by the addition of the silver nitrate aqueous solution. Rapid addition of the silver iodide fine grain emulsion is preferable.

"Rapid addition of the silver iodide fine grain emulsion" means to complete preferably the addition of the silver iodide fine grain emulsion within 10 minutes. More preferably, it means to complete the addition within 7 minutes. Although this condition may vary depending on the adding system, such as temperature, pBr, pH, kind and concentration of protective colloid such as gelatin, and presence or absence and kind and concentration of a silver halide solvent, a shorter period of time is preferable, as described above. When adding, it is preferable not to add substantially an aqueous solution of silver salt such as silver nitrate. Temperature of the system at addition ranges preferably from 40 to 90° C., and particularly preferably from 50 to 80° C.

The silver iodide fine grain emulsion is not limited as long as it is substantially comprised of silver iodide. The silver iodide fine grain emulsion may contain silver bromide and/or silver chloride as long as these can form mixed crystals. Details will be described later.

Other preferred forms of the tabular grains of the present invention are tabular silver halide host grains of 2 or higher aspect ratio each having two main planes parallel to each other (hereinafter referred to as "host tabular grains" or "host grains") and silver halide grains composed of such host grains each having its surface provided with protrusions of silver halides (hereinafter referred to as "silver halide protrusions" or "protrusions") through epitaxial junction (hereinafter referred to as "epitaxial junction tabular grains"). Herein, the protrusions refer to portions which upheave on the host grains, and can be identified by observation through an electron microscope.

The host tabular grains of the present invention are each formed of two main planes parallel to each other and sides joining the main planes with each other. Although the configuration of main planes may be any of an arbitrary polygon enclosed by lines, a circle, ellipse or the like or shape enclosed by indeterminate curve and a shape enclosed by a combination of line and curve, it is preferred that the configuration have at least one apex. More preferred configuration of the main planes is a triangle with three apexes, or a quadrangle with four apexes, or a pentagon with five apexes, or a hexagon with six apexes, or a combination thereof. Herein, the apex refers to a non-rounded corner created by two adjacent sides. When the corner is rounded, the apex refers to a point bisecting the length of rounded curve portion.

The main planes of host tabular grains for use in the present invention may have any type of crystal structure. Specifically, although the crystal structure of main planes may be any of (111) faces, (100) faces, (110) faces and higher-order faces, it is most preferred that the main planes of tabular grains consist of (111) faces or (100) faces. With respect to tabular grains whose main planes consist of (111) faces, in preferred mode, grains whose main planes have a configuration of hexagon with six apexes occupy 70% or more of the total projected area of grains. With respect to tabular grains whose main planes consist of (100) faces, in preferred mode, grains whose main planes have a configuration of quadrangle with four apexes occupy 70% or more of the total projected area of grains.

The host tabular grains for use in the present invention preferably exhibit an aspect ratio of 2 or higher, the aspect ratio referring to the quotient of grain equivalent circle diameter divided by grain thickness. This aspect ratio is more preferably in the range of 5 to 200, still more preferably 10 to 200, and most preferably 15 to 200. Herein, the equivalent circle diameter of grains refers to the diameter of a circle with an area equal to the projected area of main plane thereof.

The equivalent circle diameter of host tabular grains can be determined by, for example, taking a transmission electron micrograph according to the replica method, measuring the projected area of each individual grain through correction as to photographing magnification and calculating a diameter in terms of equivalent circle diameter from the projected area measurement. Although the grain thickness may not be simply calculated from the length of the shadow of the replica because of epitaxial deposition, the calculation can be made by measuring the length of the shadow of the replica with respect to grains before the epitaxial deposition. Alternatively, even after the epitaxial deposition, the grain thickness can be easily determined by slicing a sample after emulsion coating so as to obtain a section and taking an electron micrograph of the section.

The equivalent circle diameter of host tabular grains for use in the present invention is preferably in the range of 0.5 to 10.0 $\mu$m, more preferably 0.7 to 10.0 $\mu$m. The grain thickness thereof is preferably in the range of 0.02 to 0.5 $\mu$m, more preferably 0.02 to 0.2 $\mu$m, and most preferably 0.03 to 0.15 $\mu$m.

With respect to the host tabular grains for use in the present invention, the intergranular variation coefficient of equivalent circle diameter is preferably 40% or less, more preferably 30% or less, and most preferably 25% or less. The terminology "inter-granular variation coefficient of equivalent circle diameter" used herein means the value obtained by dividing a standard deviation of equivalent circle diameter distribution of grains by an average equivalent circle diameter and by multiplying the quotient by 100.

With respect to the epitaxial junction tabular grains, silver halide protrusions may be formed through epitaxial junction at any arbitrary position of the surfaces of host tabular grains. The formation position is preferably on the main surfaces, or apex portions or sides excluding apex portions of host tabular grains. The most preferred formation position is on the apex portions. Herein, the apex portions refer to sections enclosed by a circle of radius which is equal to ⅓ of the length of shorter side among two sides adjacent to each apex of tabular grains, as viewed perpendicularly to the main planes of tabular grains. In particular, silver halide grains having protrusions provided on all the apex portions of main planes of host tabular grains occupy 70% or more in preferred mode, 80% or more in more preferred mode and 90% or more in still more preferred mode based on the total projected area.

The amount of silver contained in the silver halide protrusions of epitaxial junction tabular grains is characterized by being 12% or less based on the amount of silver contained in host tabular grains. This ratio of silver amount is more preferably in the range of 0.5 to 10%, still more preferably 1 to 8%. When the silver amount ratio is too low, the reproducibility of epitaxial formation when repeated would be poor. On the other hand, when the ratio is too high, problems such as sensitivity lowering and graininess deterioration would occur. The proportion of the surface of silver halide protrusions to the entire grain surface is preferably 50% or less, more preferably 20% or less based on the surface of host tabular grains.

It is preferred that the silver halide protrusions of epitaxial junction tabular grains contain pseudohalide compounds. The terminology "pseudohalide compounds" means a group of compounds known as having properties similar to those of halide compounds (specifically, those which can provide satisfactorily electrically negative monovalent anion groups exhibiting at least the same positive Hammett sigma values as exhibited by halide compounds, for example, $CN^-$, $OCN^-$, $SCN^-$, $SeCN^-$, $TeCN^-$, $N_3^-$, $C(CN)_3^-$ and $CH^-$), as described in JP-A-7-72569. The content of pseudohalide compounds in the protrusions is preferably in the range of 0.01 to 10 mol %, more preferably 0.1 to 7 mol %, based on the silver quantity of the protrusions.

In the epitaxial junction tabular grains, with respect to not only the host grains but also the protrusions, the halogen composition thereof consists of pure silver bromide, or consists of, containing silver bromide at a ratio of 70 mol % or more, silver iodobromide, silver chlorobromide or silver chloroiodobromide. When the silver bromide content is less than 70 mol %, an adverse effect of intensification of fog increase after storage would occur. The silver bromide content is more preferably 80 mol % or more, most preferably 90 mol % or more.

In the epitaxial junction tabular grains, the average silver iodide content based on all the grains without exception is preferably 20 mol % or less, more preferably 15 mol % or less and most preferably 10 mol % or less. When the silver iodide content exceeds 20 mol %, it would be infeasible to obtain satisfactorily high sensitivity. An embodiment wherein the average silver iodide content of protrusions is lower than the average silver iodide content of host grain outer shell 8% (based on the silver quantity of host grains) is preferred. Herein, the host grain outer shell 8% refers to a layered region of host grains arranged from the surface toward the grain center wherein the amount of silver contained is 8% of the total silver quantity of host grains.

In the epitaxial junction tabular grains, with respect to not only the host grains but also the protrusions, the silver chloride content thereof is preferably 8 mol % or less, more preferably 4 mol % or less and most preferably 1 mol % or less.

In the epitaxial junction tabular grains, it is preferred that the intergranular distribution of silver iodide content be monodisperse. In particular, in preferred embodiment, silver halide grains whose silver iodide content is in the range of 0.6 I to 1.4 I providing that the average silver iodide content based on all the grains is I mol % occupy 70% or more of the total projected area thereof. In further preferred embodiment, silver halide grains whose silver iodide content is in the range of 0.7 I to 1.3 I occupy 70% or more of the total projected area thereof.

In the epitaxial junction tabular grains, the host grains, or protrusions, or both host grains and protrusions may contain, as portion of silver halides, silver salts other than silver chloride, silver bromide and silver iodide, for example, silver rhodanide, silver selenocyanide, silver tellulocyanide, silver sulfide, silver selenide, silver telluride, silver carbonate, silver phosphate, silver organic acid salts, etc. Alternatively, silver salts other than silver halides may be contained in the emulsion of the present invention as separate grains.

The host grains for use in the present invention may have a double structure or further multiple structure with respect to the intragranular halogen composition distribution. For example, the host grains may have a quintuple structure. Herein, the terminology "structure" refers to structuring on the intragranular distribution of silver iodide, and means that between structures, there is a silver iodide content difference of 1 mol % or more. This structure on the intragranular distribution of silver iodide can fundamentally be determined by calculation from recipe values provided in the grain preparation process. The change of silver iodide content at an interface of structures may be sharp or gentle. For identification thereof, although the measurement accuracy in analysis must be taken into consideration, the EPMA method (Electron Probe Micro Analyzer method) is generally effective. In this method, a sample wherein emulsion grains are well dispersed so as to avoid contacting thereof to each other is prepared. The sample is irradiated with electron beams so as to emit X-rays. An elemental analysis of extremely minute region having been irradiated with electron beams can be performed by an analysis of the X-rays. This measurement is preferably carried out while cooling to low temperature in order to prevent sample damaging by electron beams. This technique enables analysis of the intragranular silver iodide distribution of tabular grains when viewed perpendicularly to the main planes thereof. Further, by the use of a sample obtained by solidifying the above sample and cutting the same into extremely thin sections with a microtome, the technique enables analysis of the intragranular silver iodide distribution on a cross section of tabular grains.

In a preferred form of the silver halide emulsion of the present invention, silver halide grains wherein no dislocation line exists outside the epitaxial junction portions occupy 70% or more of the total projected area thereof. In a more preferred form, silver halide grains wherein no dislocation line exists in any regions of grains including the epitaxial junction portions occupy 70% or more of the total projected area thereof.

Next, a method of preparing tabular grains having (111) face as main planes thereof (hereinafter referred to as "(111) tabular grains"), which are one of the preferred embodiments of the host tabular grains of the present invention, will be described. The (111) tabular grains used in the present invention can be prepared by improving the methods described in Cleve, "Photography Theory and Practice (1930)", p. 13; Gutoff, "Photographic Science and Engineering", Vol. 14, pp. 248 to 257 (1970); and U.S. Pat. Nos. 4,434,226, 4,414,310, 4,433,048, and 4,439,520, and GB2,112,157, etc.

The preparation of the (111) tabular grains is basically the combination of three steps: nucleation, ripening, and growth. In the nucleation step of grains used in the present invention, it is extremely effective to use gelatin having a small methionine content described in U.S. Pat. Nos. 4,713,320 and 4,942,120, perform nucleation at a high pBr described in U.S. Pat. No. 4,914,014, and perform nucleation within short time periods described in JP-A-2-222940. In the present invention, it is particularly preferable to perform stirring in the presence of low-molecular-weight, oxidization-processed gelatin at a temperature of 20° C. to 40° C. and add an aqueous silver nitrate solution, aqueous halogen solution, and low-molecular-weight, oxidization-processed gelatin within one minute. The pBr and pH of the system are preferably 2 or more and 7 or less, respectively. The concentration of an aqueous silver nitrate solution is 0.6 mol/liter or less.

The ripening step of a tabular grain emulsion of the present invention can be performed in the presence of a low-concentration base described in U.S. Pat. No. 5,254,453 or at a high pH described in U.S. Pat. No. 5,013,641. Polyalkylene oxide compounds described in U.S. Pat. Nos. 5,147,771, 5,147,772, 5,147,773, 5,171,659, 5,210,013, and 5,252,453 can be added in the ripening step or in the subsequent growth step. In the present invention, the ripening step is preferably performed at a temperature of 50° C. to 80° C. The pBr is preferably lowered to 2 or less immediately after nucleation or during ripening. Also, additional gelatin is preferably added during a period from the timing immediately after nucleation to the end of ripening. Particularly preferred gelatin is that 95% or more of amino groups are modified by succination or trimellitation.

The growth step is usually performed by a known method of simultaneously adding an aqueous silver nitrate solution and an aqueous halide solution, but a method of adding a silver nitrate solution, a halide solution containing a bromide, and an emulsion containing silver iodide fine-grains (hereinafter referred to as a silver iodide fine-grain emulsion), as described in U.S. Pat. Nos. 4,672,027 and 4,693,964.

The silver halide grains contained in the silver iodide fine-grain emulsion substantially need only be silver iodide and can contain silver bromide and/or silver chloride as long as a mixed crystal can be formed. The emulsion is preferably 100% silver iodide. The crystal structure of silver iodide can be a β body, a γ body, or, as described in U.S. Pat. No. 4,672,026, an α body or an α body similar structure. In the present invention, the crystal structure is not particularly restricted but is preferably a mixture of β and γ bodies, and more preferably, a β body. The silver iodide fine-grain emulsion can be either an emulsion formed immediately before addition described in, e.g., U.S. Pat. No. 5,004,679 or an emulsion subjected to a regular washing step. In the present invention, an emulsion subjected to a regular washing step is preferably used. The silver iodide fine-grain emulsion can be readily formed by a method described in, e.g., U.S. Pat. No. 4,672,026. A double-jet addition method using an aqueous silver salt solution and an aqueous iodide salt solution in which grain formation is performed with a fixed pI value is preferred. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 μm or less, and more preferably, 0.07 μm or less is convenient for the present invention. Although the grain shapes cannot be perfectly specified because the grains are fine grains, the variation coefficient of a grain size distribution is preferably 25% or less. The effect of the present invention is particularly remarkable when the variation coefficient is 20% or less.

The sizes and the size distribution of the silver iodide fine-grain emulsion are obtained by placing silver iodide fine grains on a mesh for electron microscopic observation and directly observing the grains by a transmission method instead of a carbon replica method. This is because measurement errors are increased by observation done by the carbon replica method since the grain sizes are small. The grain size is defined as the diameter of a circle having an area equal to the projected surface area of the observed grain. The grain size distribution also is obtained by using this equivalent circle diameter of the projected surface area. In the present invention, the most effective silver iodide fine grains have a grain size of 0.06 to 0.02 μm and a grain size distribution variation coefficient of 18% or less.

After the grain formation described above, the silver iodide fine-grain emulsion is preferably subjected to regular washing described in, e.g., U.S. Pat. No. 2,614,929, and adjustments of the pH, the pI, the concentration of a protective colloid agent such as gelatin, and the concentration of the contained silver iodide are performed. The pH is preferably 5 to 7. The pI value is preferably the one at which the solubility of silver iodide is a minimum or the one higher than that value. As the protective colloid agent, a common gelatin having an average molecular weight of approximately 100,000 is preferably used. A low-molecular-weight gelatin having an average molecular weight of 20,000 or less also is favorably used. It is sometimes convenient to use a mixture of the gelatins having different molecular weights. The gelatin amount is preferably 10 to 100 g, and more preferably, 20 to 80 g per kg of an emulsion. The silver amount is preferably 10 to 100 g, and more preferably, 20 to 80 g, as the amount of silver atoms, per kg of an emulsion. The silver iodide fine-grain emulsion is usually dissolved before being added. During the addition it is necessary to sufficiently raise the efficiency of stirring of the system. The rotational speed of stirring is preferably set to be higher than usual. The addition of an antifoaming agent is effective to prevent the formation of foam during the stirring. More specifically, an antifoaming agent described in, e.g., examples of U.S. Pat. No. 5,275,929 is used.

In the growth step of the present invention, an external stirring apparatus described in JP-A-10-43570 can be used. That is, an emulsion containing fine grains of silver bromide, silver iodobromide, or silver iodochlorobromide (hereinafter referred to as an "ultrafine-grain emulsion"), which is prepared in the stirring apparatus immediately before addition thereof, is continuously added, whereupon it dissolves and the tabular grains grow. The external mixer used for preparing the ultrafine-grain emulsion has a high stirring power. An aqueous silver nitrate solution, aqueous halide solution, and gelatin are added to the mixer. Gelatin can be mixed in the aqueous silver nitrate solution and/or the aqueous halide solution beforehand or immediately before the addition. Alternatively, an aqueous gelatin solution can be added separately. The average molecular weight of the gelatin is preferably lower than usual, and more preferably, 10,000 to 50,000. It is particularly preferable to use a gelatin in which 90% or more of amino groups are modified by phthalation, succination, or trimellitation and/or an oxidization-processed gelatin whose methionine content is decreased.

The process for producing another preferred form of the host tabular grains according to the present invention, namely, tabular grains whose main planes consist of (100) faces (hereinafter referred to as "(100) tabular grains") will be described below. Formation of the (100) tabular grains is preferably performed in the presence of a polyvinyl alcohol derivative (hereinafter referred to as "polymer P"). The polymer P is strongly adsorbed onto silver halide grains to thereby exhibit strong protective colloid capacity and hinders further lamination of the adsorption face with silver halides.

The formation of tabular nuclei for the (100) tabular grains is completed by adsorption of polymer P on a pair of (100) faces capable of becoming main planes of silver halide grains and adsorption of gelatin on sides (other faces). These tabular nuclei may be formed through procedure (a) comprising adding $Ag^+$ ion and $X^-$ ion to an aqueous solution containing polymer P and gelatin. Alternatively, the tabular nuclei can be formed through procedure (b) comprising adding $Ag^+$ ion and $X^-$ ion to an aqueous solution containing gelatin only so as to produce microcrystals and thereafter adding polymer P to the mixture. When at the unstable nucleation initial stage the adsorptive power of polymer P and gelatin can be satisfactorily controlled, the formation of tabular nuclei through procedure (a) is preferred from the viewpoint of attainment of thickness monodispersion.

The adsorptive power of polymer P and gelatin can be controlled by regulating the types (molecular weight, types of substituents, etc.) of employed polymer P and gelatin, addition amount thereof, pH and pAg during tabular nuclei formation, etc. For example, the adsorptive power of polymer P is increased in accordance with an increase of the molecular weight thereof. Hence, in that instance, it is needed to increase the molecular weight of gelatin as well so as to attain a balance of adsorptive power, or to increase the amount of gelatin used so as to attain a balance of adsorptive power. In the nucleation, it is the first priority to realize a state of intergranularly uniform adsorption of polymer P and gelatin. For this, it is preferred to reduce the amount of polymer P used. Thus, it is needed to select the type and addition amount of gelatin in accordance therewith and further to select the pH and pAg values suitable therefor. The adsorptive power depends on the relative relationship among the crystal phase on the surface of AgX grains, the polymer P and the gelatin, and cannot be uniquely determined.

In the ripening and growth steps after nucleation as well, the balance of adsorptive power must be changed according to necessity. The ripening step is not needed when all the tabular nuclei formed through the procedures (a) and (b) are favorable (aforementioned state of polymer P adsorbed on a pair of (100) faces capable of becoming main planes with gelatin adsorbed on sides (other faces)), but is needed when unfavorable nuclear crystals are mixed. In this instance, the unfavorable nuclear crystals can be eliminated by the Ostwald ripening, in which the ripening is accelerated by reducing the adsorptive power of polymer P having strong protective colloid capacity. It is also preferred to create an atmosphere for ripening acceleration by raising the temperature, or to add $Ag^+$ ion and $X^-$ ion to thereby effect ripening acceleration.

In the step of growing (100) tabular grains, it is preferred that the addition of $Ag^+$ ion and $X^-$ ion be effected so as to maintain a state of low supersaturation, if possible, in conditions such that the greatest difference occurs between the adsorptive powers of polymer P and gelatin, namely, such that the greatest difference occurs between the main plane and side solubilities. When it is intended to make a difference between adsorptive powers, the simplest and most favorable means is to control the adsorptive powers of polymer P and gelatin through pH.

In the formation of (100) tabular grains, it is preferred to add a spectral sensitizing dye prior to the completion of grain formation. Since the polymer P is strongly adsorbed onto silver halide grains, adsorption of a spectral sensitizing dye onto the main plane with large surface area is accomplished by substituting the spectral sensitizing dye for the polymer P while maintaining the silver halide surface at a dynamic state (namely, while permitting new lamination by addition of silver ions and halide ions). It is also preferred that gelatin be added for relatively lowering the adsorptive power of polymer P to thereby accelerate the substitution.

Now, the method of forming silver halide protrusions epitaxially joined onto the surface of host tabular grains according to the present invention will be described. The formation of protrusions may be performed immediately after the formation of host tabular grains, or may be performed after ordinary desalting subsequent to the formation of host tabular grains. Preferably, the formation of protrusions is performed immediately after the formation of host tabular grains.

It is preferred to use a site director for forming the protrusions of the present invention. Although various substances can be used as the site director, it is preferred to use a spectral sensitizing dye. The position of protrusions can be controlled by selecting the amount and type of dye employed. The spectral sensitizing dye is added preferably in an amount corresponding to 50–200% of saturated covering amount, more preferably in an amount corresponding to 70–150% of saturated covering amount. Examples of employed dyes include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes. These dyes may contain any of nuclei commonly used in cyanine dyes as basic heterocyclic nuclei. Examples of such nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

These spectral sensitizing dyes may be used either alone or in combination. The spectral sensitizing dyes are often used in combination for the purpose of attaining supersensitization. Representative examples thereof are described in, for example, U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GB's 1,344,281 and 1,507,803, JP-B's-43-4936 and 53-12375, and JP-A's-52-110618 and 52-109925. Dyes themselves not exhibiting spectral sensitizing activity or substances substantially not absorbing visible light but capable of exhibiting supersensitization may be simultaneously or separately added in combination with the spectral sensitizing dyes.

With respect to the method of forming protrusions, not only a mode of adding a spectral sensitizing dye as a site director prior to formation of protrusions but also a mode of first forming protrusions and thereafter effecting supplemental addition of a spectral sensitizing dye is preferred. The supplementary spectral sensitizing dye not only functions for stable retention of protrusions but also brings about the advantage of sensitivity enhancement. In that instance, the same type of dye as the spectral sensitizing dye added prior to the formation of protrusions may be used, or different types of dyes may be incorporated.

The silver halide protrusions of the silver halide emulsion of the present invention can be formed by addition of a solution containing silver nitrate. In that instance, although a mode of simultaneously adding an aqueous solution of silver nitrate and a halide solution is often employed, the halide solution can be added separately from the silver nitrate solution. Alternatively, the silver halide protrusions can be formed by addition of silver bromide fine grains, silver iodide fine grains or silver chloride fine grains having a grain diameter smaller than the thickness of host tabular grains, or by addition of fine grains composed of mixed crystals thereof. In the mode of simultaneously adding an aqueous solution of silver nitrate and a halide solution, it is preferred to effect the addition while maintaining the pBr of the system at a constant value. The addition time of silver nitrate solution is preferably in the range of 30 sec to 300 min, more preferably 1 min to 200 min. The concentration of silver nitrate solution is preferably 1.5 mol/liter or below, more preferably 1.0 mol/liter or below (hereinafter, liter is also referred to as "L"). The pBr value during the formation of silver halide protrusions is preferably 3.5 or higher, more preferably 4.0 or higher. The temperature is preferably in the range of 35 to 45° C. The pH value is preferably in the range of 3 to 8, more preferably 5 to 8.

The incorporation of pseudohalides in protrusions can be effected by adding pseudohalide salts prior to or during the formation of protrusions, or by adding them to a halide solution to be simultaneously added with silver nitrate. For example, KCN, KSCN, KSeCN or the like can be used in the addition.

In the present invention, the content of pseudohalides in protrusions can be measured by the following method. The tabular silver halide grains of silver halide photosensitive material are taken out by treating the photosensitive material with a proteolytic enzyme and carrying out centrifugation. The thus obtained grains are redispersed and mounted on a copper mesh clad with a support film. Point analysis by means of an analytical electron microscope with a spot diameter reduced to 2 nm or less is performed with respect to the protrusions of the grains, thereby measuring the content of pseudohalides. The content of pseudohalides can be determined by determining in advance, as a calibration curve, the ratio between Ag intensity and pseudohalide intensity after treating silver halide grains of known content in the same manner. For example, with respect to $SCN^-$, the pseudohalide content can be determined from the ratio between Ag intensity and S intensity. As an analytical radiation source for the analytical electron microscope, a field emission type electron gun of high electron density is more suitable than one using thermoelectrons. By reducing the spot diameter to 1 nm or less, the pseudohalide content of protrusions can be easily analyzed. When the intergranular variation coefficient of pseudohalide content of protrusions is 30% or below, the pseudohalide content is generally determined by measuring with respect to 20 grains and averaging the measurements. When the intergranular variation coefficient of pseudohalide content of protrusions is 20% or below, the pseudohalide content is generally determined by measuring with respect to 10 grains and averaging the measurements. It is preferred that the intergranular variation coefficient of pseudohalide content of protrusions be 20% or below.

The silver halide grain of the present invention preferably has a hole-trapping zone within the grain. The hole-trapping zone in the present invention refers to a region having a function of capturing a so-called hole, e.g., a hole generated in pairs with a photoelectron generated by the optical excitation. There are various methods for providing such a hole-trapping zone. It is desirable in the present invention that the hole-trapping zone be provided by reduction sensitization.

In the present invention, the hole-trapping zone may be present within the grain or on the grain surface, or both within the grain and on the surface. When the grain is epitaxial tabular grain the hole-trapping zone may be present at the host grain, the protrusion portion or at both the host grains and the protrusion portion. However, reduction silver nuclei are easily destroyed by oxygen or moisture in the air. Thus, if an emulsion itself and a photosensitive material are to be preserved over the long term, it is preferable that the hole-trapping zone be present inside the grain or at the host grain.

In general, the process for manufacturing the silver halide emulsion can be broadly divided into steps, such as grain formation, desalting, chemical sensitization, etc. Grain formation is divided into nucleation, ripening, growth, etc. These steps need not necessarily be carried out in this order. The order may be reversed, or one step may be repeatedly performed. Basically the silver halide emulsion is subjected to reduction sensitization at any stage of each manufacturing step. Reduction sensitization may be performed at the time of nucleation, which is an early stage of grain formation, at the time of physical ripening, or at the time of growth. Reduction sensitization may be performed prior to chemical sensitization, other than reduction sensitization, or after chemical sensitization. The reduction sensitization may be performed prior to chemical sensitization other than reduction sensitization, r may be performed after the chemical sensitization. When chemical sensitization in which gold sensitization is used in combination, is performed, it is preferred that the reduction sensitization is performed prior to the chemical sensitization so that unfavorable fog occurs. Most preferably, the reduction sensitization is performed during growth of host grains. The "method of reduction sensitization during the growth" includes the method of performing reduction sensitization whilst the silver halide grain is growing by physical ripening or addition of a water-soluble silver salt and water-soluble alkali halide. It also includes the method wherein during the growth, reduction sensitization is performed after a growth step is temporarily stopped, before a next growth step is initiated.

The reduction sensitization can be selected from a method of adding reduction sensitizers to a silver halide emulsion, a method called silver ripening in which grains are grown or ripened in an atmosphere of low-pAg at pAg 1 to 7, and a method called high-pH ripening in which grains are grown or ripened in an atmosphere of high-pH at pH 8 to 11. Two or more of these methods can also be used together.

The method of adding reduction sensitizers is preferable in that the level of reduction sensitization can be finely adjusted. Known examples of the reduction sensitizer are stannous salts, amines and poly amino acids, hydrazine derivatives, formamidinesulfinic acid, silane compounds, borane compounds, ascorbic acid and derivatives thereof. In the reduction sensitization used in the present invention, it is possible to selectively use these known reduction sensitizers or to use two or more types of compounds together. Preferred compounds as the reduction sensitizer are stannous chloride, thiourea dioxide, dimethylamineborane, and ascorbic acid and its derivative. Although the addition amount of the reduction sensitizers must be so selected as to meet the emulsion manufacturing conditions, a preferred amount is $10^{-7}$ to $10^{-3}$ mol per mol of a silver halide. When ascorbic acid compound is used, a suitable amount is $5\times10^{-5}$ to $1\times10^{-1}$ mol per mol of a silver halide.

The reduction sensitizers are dissolved in water or an organic solvent, such as alcohols, glycols, ketones, esters, or amides, and the resultant solution is added during grain formation, before or after chemical sensitization. Although the reduction sensitizer may be added at any stage of emulsion preparing steps, but the method of adding the reduction sensitizer during grain growth is especially preferable. Although adding to a reactor vessel in advance is also preferable, adding at a proper timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers can be added separately several times or continuously over a long time period with grain growth.

In order to dispose a hole-trapping zone only inside the grain, it is effective that at least one compound selected from the compounds represented by the following formulae (A), (B) or (C) is contained.

$$G\text{-}SO_2S\text{-}M \quad (A)$$

$$G\text{-}SO_2S\text{-}G_1 \quad (B)$$

$$G\text{-}SO_2S\text{-}L_m\text{-}SSO_2\text{-}G_2 \quad (C)$$

In the formulae, G, $G_1$ and $G_2$ may be different or the same, and represent an aliphatic group, an aromatic group, or a heterocyclic group. M represents a cation, L represents a divalent linkage group, and m is 0 or 1. The compounds of formulae (A) to (C) may be polymer containing a divalent group derived from the structure represented by formulae (A) to (C) as their repeating units. In formula (B), G and $G_1$ may form a ring. In formula (C), two of G, $G_2$ and L may be bonded to each other to form a ring.

The compounds of the formulae (A), (B) and (C) will be explained more specifically. If the G, $G_1$ and $G_2$ are an aliphatic group, the aliphatic group are a saturated or unsaturated, linear, branched, or cyclic, aliphatic hydrocarbon group, and preferably, an alkyl group having 1 to 22 carbon atoms, and alkenyl and alkynyl groups each having 2 to 22 carbon atoms. These groups may have a substituent. Examples of the alkyl group are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the alkenyl group are allyl and butenyl. Examples of the alkynyl group are propargyl and butynyl. The aromatic group of the G, $G_1$ and $G_2$ includes a monocyclic or condensed-ring aromatic group, and preferably, a group having 6 to 20 carbon atoms. Examples of such an aromatic group are a phenyl group and a naphthyl group. These groups may be substituted.

The heterocyclic group of the G, $G_1$ and $G_2$ are a 3- to 15-membered heterocyclic group containing at least one element selected from nitrogen, oxygen, sulfur, selenium, and tellurium. Examples of such a heterocyclic group are a pyrrolidine ring, piperidine ring, pyridine ring, tetrahydrofuran ring, thiophene ring, oxazole ring, thiazole ring, imidazole ring, benzothiazole ring, benzoxazole ring, benzimidazole ring, selenazole ring, benzoselenazole ring, tetrazole ring, triazole ring, benzotriazole ring, tetrazole ring, oxadiazole ring, and thiadiazole ring.

Examples of the substituent of the G, $G_1$ and $G_2$ are an alkyl group (such as methyl, ethyl, and hexyl), an alkoxy group (such as methoxy, ethoxy, and octyloxy), an aryl group (such as phenyl, naphthyl, and tolyl), a hydroxy group, a halogen atom (such as fluorine, chlorine, bromine, and iodine), an aryloxy group (such as phenoxy), an alkylthio group (such as methylthio, and butylthio), an arylthio group (such as phenylthio), an acyl group (such as acetyl, propionyl, butyryl, and valeryl), a sulfonyl group (such as methylsulfonyl, and phenylsulfonyl), an acylamino group (such as acetylamino, and benzamino), a sulfonylamino acid (such as methane sulfonylamino and benzene sulfonylamino), an acyloxy group (acetoxy, and benzoxy), a carboxyl group, a cyano group, a sulfo group, and an amino group.

The divalent linkage group represented by L is an atom or an atomic group containing at least one selected from C, N, S and O. To be more specific, the divalent linkage group consists either individually or in combination of an alkylene group, alkenylene group, alkynylene group, arylene group, —O—, —S—, —NH—, —CO—, —$SO_2$—, etc.

L is preferably a divalent aliphatic group or a divalent aromatic group. Examples of the divalent aliphatic group of L are —$(CH_2)_n$-(n=1 to 12), —$CH_2$—CH═CH—$CH_2$—, —$CH_2$C≡-$CCH_2$—, and a xylylene group. Examples of the divalent aromatic group are phenylene and naphthylene. These substituents may further be substituted by the aforementioned substituents.

M is preferably a metal ion or an organic cation. Examples of the metal ion are a lithium ion, sodium ion, and potassium ion. Examples of the organic cation are an ammonium ion (such as ammonium, tetramethylammonium, and tetrabutylammonium), a phosphonium ion (tetraphenylphosphonium), a guanidine group, etc.

The examples of the compounds represented by the formulae (A), (B) or (C) are described in JP-A-10-268456.

The compounds expressed by the formulae (A), (B) or (C) can easily be synthesized by the methods described in JP-A-54-1019 and GB972,211.

The amount of the compound represented by the formula (A), (B) or (C) is preferably $10^{-7}$ to $10^{-1}$ mol per mol of a silver halide, more preferably $10^{-5}$ to $10^{-2}$ mol/molAg, and most preferably $10^{-5}$ to $10^{-3}$ mol/molAg.

In order to add the compound represented by the general formulae (A) to (C) during preparation steps, a method commonly used in the case of adding an additive to a photographic emulsion is applicable. For example, a water-soluble compound can be added, in a suitable concentration, as an aqueous solution. A water-insoluble or sparingly-water-soluble compound can be dissolved in a suitable water-miscible organic solvent selected from, for example, alcohols, glycols, ketones, esters, amides having no adverse affect on the photographic properties, can be added as a solution.

The compound represented by the general formula (A), (B) or (C) may be added at any point during preparation of silver halide emulsion, such as during grain formation, before or after chemical sensitization. The method of adding the compound before or during reduction sensitization is preferable. The method of adding the compound during the grain growth is especially preferable.

Although adding the compound represented by general formulae (A) to (C) to a reactor vessel in advance is also preferable, adding the compound at a proper timing during grain formation is more preferable. It is also possible to add the compound of general formula (I), (II) or (III) to an aqueous solution of a water-soluble silver salt or a water-soluble alkali halide to precipitate silver halide grains by using these aqueous solutions. Alternatively, a solution containing the compound of general formula (A), (B) or (C) can be added separately several times or continuously over a long time period with grain growth.

Among the compounds represented by general formula (A), (B) and (C), the compound represented by general formula (A) is most preferable in the present invention.

As another method of forming hole-trapping zone only inside a grain, method of using oxidizer is effective. The oxidizer can be either an inorganic or organic substance. Examples of the inorganic oxidizer are ozone, hydrogen peroxide and its adduct (e.g., $NaBO_3.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_4O_8$, $K_2C_2O_6$, and $K_4P_2O_8$), a peroxy complex compound (e.g., $K_2[TiO_2C_2O_4].3H_2O$, $4K_2SO_4.TiO_2.OH.2H_2O$, and $Na_3[VOO_2(C_2H_4)_2.6H_2O]$, permanganate (e.g., $KMnO_4$), an chromic acid salt such (e.g., $K_2Cr_2O_7$), a halogen element such as iodine and bromine, perhalogenate (e.g., potassium periodate), a salt of a high-valence metal (e.g., potassium hexacyanoferrate(II)). Examples of the organic oxidizer are quinones such as p-quinone, an organic peroxide such as peracetic acid and perbenzoic acid, and a compound capable of releasing active halogen (e.g., N-bromosuccinimide, chloramine T, and chloramine B). Preferable amount, time and method of adding these oxidizers are the same as those of the above compounds represented by general formulae (A), (B) and (C).

Oxidizers used in the present invention are preferably ozone, hydrogen peroxide and its adduct, a halogen element, thiosulfonate and quinones, further preferably, thiosulfonate compounds represented by general formulae (A) to (C), and most preferably, the compound represented by general formula (A).

Arranging of hole trap zones on grain surfaces can be accomplished by performing the above reduction sensitization after the formation of 90% or more (in terms of silver quantity) of grains.

The silver halide grains of the present invention also preferably have temporary electron-trapping zones. In the present invention, the temporary electron-trapping zones refer to regions which in the photosensitization process, are capable of temporarily trapping photoelectrons within the period until photoelectrons generated by photoexcitation form latent images. These temporary electron-trapping zones can be realized by carrying out doping with a transition metal complex.

Examples of the transition metal complexes being suitable as a dopant preferably incorporated in the interior and/or surface of silver halide grains in the present invention will be set forth below. As a metal ion constituting a central metal of transition metal complexes, it is preferred to employ iron, ruthenium, iridium, cobalt, osmium, rhodium or palladium. These metal ions are preferably used in the form of a six-coordinate octahedral complex together with ligands. When an inorganic compound is used as the ligands, it is preferred to employ any of cyanide ion, halide ion, thiocyan, hydroxide ion, peroxide ion, azide ion, nitrite ion, water, ammonia, nitrosyl ion and thionitrosyl ion. These ligands may be coordinated with any of the above metal ions. Each metal ion at the coordination site may be coordinated with ligands of the same type, or may be simultaneously coordinated with ligands of two or more types. Moreover, an organic compound can be used as the ligands. When an organic compound is used as the ligands, it is preferred to use a chain compound whose main chain has 5 or less carbon atoms and/or a 5- or 6-membered heterocyclic compound. In particular, it is more preferred to use a compound having in its molecule a nitrogen atom, a phosphorus atom, an oxygen atom or a sulfur atom as an atom capable of coordination with a metal. It is most preferred to use furan, thiophene, oxazole, isoxazole, thiazole, isothiazole, imidazole, pyrazole, triazole, furazane, pyran, pyridine, pyridazine, pyrimidine or pyrazine. Furthermore, compounds comprising these compounds as fundamental skeletons wherein substituents have been introduced are also preferably used. These transition metal complexes are preferably incorporated, per mol of silver, in an amount of $1\times10^{-10}$ to $1\times10^{-2}$ mol, more preferably $1\times10^{-8}$ to $1\times10^{-3}$ mol.

With respect to the above transition metal complexes, the metal ion as the central metal is most preferably iron, ruthenium or iridium. When the central metal is iron or ruthenium, as a combination with the above ligands, there can preferably be mentioned a combination of iron ion and cyanide ion or a combination of ruthenium ion and cyanide ion. With respect to these combinations, it is preferred that cyanide ions occupy over half of the coordination number of iron or ruthenium as the central metal. More preferably, the rest of coordination sites are occupied by any of thiocyan, ammonia, water, nitrosyl ion, dimethyl sulfoxide, pyridine, pyrazine and 4,4'-bipyridine. It is most preferred that all the six coordination sites of central metal be occupied by cyanide ions, thereby forming a hexacyanoiron complex or a hexacyanoruthenium complex. As preferred specific examples of complexes wherein iron or ruthenium is used as the central metal, there can be mentioned $[Fe(CN)_6]^{4-}$, $[Fe(CN)_6]^{3-}$, $[Ru(CN)_6]^{4-}$, $[Fe(pyrazine)(CN)_5]^{4-}$, $[Fe(CO)(CN)_5]^{3-}$, $[RuF_2(CN)_4]^{4-}$, $[Ru(CN)_5(OCN)]^{4-}$, $[Ru(CN)_5(N_3)]^{4-}$, $[Fe(CN)_3Cl_3]^{3-}$ and $[Ru(CO)_2(CN)_4]^{1-}$. On the other hand, when iridium is used as the central metal, fluoride ion, chloride ion, bromide ion, iodide ion, cyanide ion and thiocyanate ion are preferably used as the ligands. Among these, chloride ion and bromide ion are more preferred. It is preferred that these ligands occupy over half of the coordination number of iridium. Preferably, the rest of coordination sites are occupied by any of thiocyan, ammonia, water, nitrosyl ion, dimethyl sulfoxide, pyridine, pyrazine and 4,4'-bipyridine. As preferred specific examples of metal complexes wherein iridium is used as the central metal, there can be mentioned $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, $[IrBr_3(H_2O)_3]^{+}$, $[Ir(CN)_6]^{3-}$, $[IrBr(CN)_5]^{3-}$, $[IrBr_2(CN)_4]^{3-}$, $[Ir(CN)_5(H_2O)]^{2-}$, $[Ir(CN)_4(oxalate)]^{3-}$ and $[Ir(NCS)_6]^{3-}$.

Next, the chemical sensitization of the silver halide grains of the present invention will be described. In the present invention, chemical sensitization ma be performed before or after desalting.

One chemical sensitization which can be preferably performed in the present invention is chalcogen sensitization, noble metal sensitization, or the combination of these. Chemical sensitization can be performed by using an active gelatin as described in T. H. James, The Theory of the Photographic Process, 4th ed., Macmillan, 1977, pp. 67 to 76. Chemical sensitization can also be performed by using any of sulfur, selenium, tellurium, gold, platinum, palladium, and iridium, or by using the combination of a plurality of these sensitizers at pAg 5 to 10, pH 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent No. 1,315,755. In noble metal sensitization, salts of noble metals, such as gold, platinum, palladium, and iridium, can be used. In particular, gold sensitization, palladium sensitization, or the combination of the two is preferred. In gold sensitization, it is possible to use known compounds, such as chloroauric acid, potassium chloroaurate, potassium aurithiocyanate, gold sulfide, and gold selenide, or meso-ionic gold compound as described in U.S. Pat. No. 5,220,030 or azole gold compound as described in U.S. Pat. No. 5,049,484. A palladium compound means a divalent or tetravalent salt of palladium. A preferred palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom. More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. The gold compound and the palladium compound are preferably used in combination with thiocyanate or selenocyanate.

In the emulsion of the invention, gold sensitization is preferably combined. The preferable amount of the gold sensitizer is $1\times10^{-3}$ to $1\times10^{-7}$ mol, more preferably $1\times10^{-4}$ to $5\times10^{-7}$ per mol of silver halide. The preferable amount of the palladium compound is $1\times10^{-3}$ to $5\times10^{-7}$ mol per mol of silver. The preferable amounts of the thiocyan compound and selenocyan compound are $5\times10^{-2}$ to $1\times10^{-6}$ mol per mol of silver halide.

Examples of a sulfur sensitizer are hypo, a thiourea-based compound, a rhodanine-based compound, and sulfur-containing compounds described in U.S. Pat. Nos. 3,857,711, 4,266,018, and 4,054,457. Chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of a modifier of the chemical sensitization aid are described in U.S. Pat. Nos. 2,131,038, 3,411,914, and 3,554,757, JP-A-58-126526, and G. F. Duffin, Photographic Emulsion Chemistry, pp. 138 to 143. The preferable amount of the sulfur sensitizer is $1\times10^{-4}$ to $1\times10^{-7}$, more preferably $1\times10^{-5}$ to $5\times10^{-7}$ per mol of silver halide.

The silver halide emulsions of the present invention are preferably subjected to selenium sensitization. Selenium compounds disclosed in hitherto published patents can be used as the selenium sensitizer in the present invention. In the use of liable selenium compound and/or nonliable selenium compound, generally, it is added to an emulsion and the emulsion is agitated at high temperature (preferably 40° C. or above) for a given period of time. Compounds described in, for example, JP-B's-44-15748 and 43-13489, JP-A's-4-25832 and 4-109240 are preferably used as the liable selenium compound.

Specific examples of the liable selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2, 6-dimethoxybenzoyl) selenide), selenophosphates, phosphine selenides and colloidal metal selenium.

The liable selenium compounds, although preferred types thereof are as mentioned above, are not limited thereto. It is generally understood by persons of ordinary skill in the art to which the invention pertains that the structure of the liable selenium compound as a photographic emulsion sensitizer is not so important as long as the selenium is liable and that the liable selenium compound plays no other role than having its selenium carried by organic portions of selenium sensitizer molecules and causing it to present in unstable form in the emulsion. In the present invention, the liable selenium compounds of this broad concept can be used advantageously.

Compounds described in JP-B's-46-4553, 52-34492 and 52-34491 can be used as the nonliable selenium compound in the present invention. Examples of the nonliable selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in water, or, a single or mixed organic solvent, such as methanol or ethanol, and added at the time of chemical sensitization. Preferably, the selenium sensitizer is added before the initiation of chemical sensitization. The number of selenium sensitizers to be used is not limited to one, and two or more of the above sensitizers can be used in combination. The combined use of the liable selenium compound and the non-liable selenium compound is preferable.

Although the amount of the selenium sensitizer used in the present invention varies according to the activity of the selenium sensitizer used, type or size of the silver halide, temperature or time of ripening, etc., $1\times10^{-8}$ mol per mol of a silver halide or more is preferable. $1\times10^{-7}$ mol or more, and $5\times10^{-5}$ mol or less is more preferable. If a selenium sensitizer is used, chemical ripening is preferably performed at 40° C. or more and 80° C. or less. The pAg and pH are freely chosen. Concerning the pH, for example, the effect of the present invention can be obtained within a wide range of 4 to 9.

The selenium sensitization is preferably performed in combination with either sulfur sensitization or noble metal sensitization, or both. In the present invention, it is preferable that thiocyanate is added to the silver halide emulsion at the time of chemical sensitization. As the thiocyanate, potassium thiocyanate, sodium thiocyanate, ammonium thiocyanate, etc., are used. The thiocyanate is usually dissolved in an aqueous water solution or water-soluble solvent before being added. The amount of the thiocyanate added is $1\times10^{-5}$ mol to $1\times10^{-2}$ mol per mol of a silver halide, and more preferably, $5\times10^{-5}$ mol to $5\times10^{-3}$ mol.

In the emulsion used in the present invention, the surface of a grain or any location further inside may be chemically sensitized. In the case of chemically sensitizing the inside, a method described in JP-A-63-264740 can be referred to. The lower the chloride ion content of the epitaxially Functioned silver halide protrusion portion is, the higher the chemical sensitization tends to be inside. If the protrusion portion is formed in the presence of thiocyante ions, the area further inside the grain is chemically sensitized.

The tabular silver halide grains of the present invention are spectrally sensitized by spectral sensitizing dyes. The addition amount of spectral sensitizing dye is preferably in the range of $1\times10^{-4}$ to $1\times10^{-2}$ mol, more preferably $2\times10^{-4}$ to $5\times10^{-3}$ mol, per mol of silver.

The total amount of spectral sensitizing dyes contained in the photosensitive material of the present invention (total amount of all spectral sensitizing dyes irrespective of the purpose of use thereof) is preferably in the range of 18 to 200 milligrams/$m^2$, more preferably 20 to 80 milligrams/$m^2$.

Although the advantages of the present invention can be exerted even when the configuration of silver halide grains is not tabular as long as the total amount of spectral sensitizing dyes falls within the above range, the advantages are especially striking when use is made of a photosensitive material containing grains having an average aspect ratio of 8 or greater (preferably 10 or greater), or containing grains having an average equivalent sphere diameter of 0.55 $\mu$m or less (preferably 0.5 $\mu$m or less) and having an average aspect ratio of 2 or greater (preferably 3 or greater), wherein the total amount of spectral sensitizing dyes is in the range of 18 to 200 milligrams/$m^2$ (preferably 20 to 80 milligrams/$m^2$).

In the silver halide photosensitive material of the present invention, the layer containing an emulsified dispersion wherein the surfactant of the general formula (I) is contained and the layer containing an emulsion wherein tabular silver halide grains having an average aspect ratio of 8 or greater and at least one type of sensitizing dye are contained may be identical with each other or separate from each other. Similarly, the layer containing an emulsified dispersion wherein the surfactant of the general formula (I) is contained and the layer containing an emulsion wherein tabular silver halide grains having an average equivalent sphere diameter of 0.55 $\mu$m or less and having an average aspect ratio of 2 or greater, and at least one type of sensitizing dye are contained may be identical with each other or separate from each other.

Next, another preferred embodiment of the silver halide emulsion of the present invention will be explained. It is preferable that the proper amount of calcium ions and/or magnesium ions be contained in the silver halide emulsion of the present invention. Thereby, the graininess and the image quality are increased, and the storability is also improved. The appropriate amounts are: 400 to 2500 ppm of calcium, and/or 50 to 2500 ppm of magnesium, more preferably, 500 to 2000 ppm of calcium, and/or 200 to 2000 ppm of magnesium. The "400 to 2500 ppm of calcium, and/or 50 to 2500 ppm of magnesium" refers to the state in which the concentration of at least one of the two elements is within the specified range. If the calcium or magnesium content is higher than these values, an inorganic salt may be precipitated from the calcium salt, magnesium salt or gelatin, etc. This disrupts the process of manufacturing the lightsensitive material, which is unpreferable. The "calcium or magnesium content" refers to the concentration per unit weight of the emulsion by expressing all the compounds containing calcium or magnesium, such as calcium ions, magnesium ions, calcium salt, magnesium salt, in terms weight of calcium atoms or magnesium atoms.

Calcium to be added to the silver halide emulsion of the present invention may be added an arbitral timing of the emulsion preparation steps, but the mode of adding calcium prior to the formation of a silver halide protrusion portion is preferable. Further, a mode of additionally adding calcium after the formation of the protrusion portion is also preferable.

Calcium is usually added in the form of a calcium salt. As the calcium salt, calcium nitrate and calcium chloride are preferable, and calcium nitrate is most preferable. Similarly, the magnesium content can be controlled by the addition of a magnesium salt at the time of preparing the emulsion. As the magnesium salt, magnesium nitrate, magnesium sulfate and magnesium chloride are preferable, and magnesium nitrate is most preferable. As a quantitative method for determining the calcium or magnesium content, the ICP emission spectral analysis method may be used. The calcium and magnesium can be used alone or in combination, but it is preferable that calcium be contained.

As a compound especially useful for the purpose of reducing fog and suppressing fog increase during storage, a mercaptotetrazole compound having a water-soluble group described in JP-A-4-16838 is used. This publication discloses that the storability is enhanced by using a mercaptotetrazole compound and a mercaptothiadiazole compound in combination.

Photographic emulsions used in the present invention can contain various compounds in order to prevent fog during the manufacturing process, storage, or photographic processing of a sensitive material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; and azaindenes such as triazaindenes, tetrazaindenes (particularly 4-hydroxy-substituted(1, 3, 3a, 7)tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

It is advantageous to use gelatin as a protective colloid for use in the preparation of emulsions of the present invention or as a binder for other hydrophilic colloid layers. However, another hydrophilic colloid can also be used in place of gelatin. Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

The silver halide photosensitive material of the present invention is characterized in that the surfactant of the general formula (I) is contained therein. Typical form thereof is a silver halide color photosensitive material comprising at least one blue-sensitive emulsion layer wherein a yellow color-forming coupler is contained, at least one green-sensitive emulsion layer wherein a magenta color-forming coupler is contained and at least one red-sensitive emulsion layer wherein a cyan color-forming coupler is contained.

The advantages of the present invention are especially of great value in silver halide color photosensitive materials for shooting purposes, such as a color negative film and a color reversal film. Thus, it is preferred that the present invention be applied to these color films. It is most preferred that the present invention be applied to a color reversal film capable of direct image appreciation.

The silver halide color film (color reversal film or color negative film) as preferred embodiment of the present invention will be described in detail below.

The color film photosensitive material of the present invention is not limited as long as it comprises a transparent support and, superimposed thereon, at least one blue-sensitive silver halide emulsion layer wherein a yellow dye forming coupler is contained, at least one green-sensitive silver halide emulsion layer wherein a magenta dye forming coupler is contained and at least one red-sensitive silver halide emulsion layer wherein a cyan dye forming coupler is contained. It is preferred that each of the color-sensitive emulsion layers be a color-sensitive unit comprising a combination of two or more light-sensitive emulsion layers of different photographic speeds. Preferably, these color-sensitive emulsion layers (or color-sensitive units) are arranged in the sequence, from the side close to the support, of red-sensitive silver halide emulsion layer (or red-sensitive unit), green-sensitive silver halide emulsion layer (or green-sensitive unit) and blue-sensitive silver halide emulsion layer (or blue-sensitive unit). In the color-sensitive unit arrangement, it is preferred that each of the units have a three-layer unit structure composed of three light-sensitive emulsion layers arranged in the sequence, from the side close to the support, of low-speed layer, medium-speed layer and high-speed layer. These are described in, for example, JP-B-49-15495 and JP-A-59-202464.

One preferred embodiment of the present invention is a photosensitive element in which a support is coated with layers in the order of an undercoat layer/antihalation layer/first interlayer/red-sensitive emulsion layer unit (including three layers in the order of a low-speed red-sensitive layer/medium-speed red-sensitive layer/high-speed red-sensitive layer from the one closest to the support)/second interlayer/green-sensitive emulsion layer unit (including three layers in the order of a low-speed green-sensitive layer/medium-speed green-sensitive layer/high-speed green-sensitive layer from the one closest to the support)/third interlayer/yellow filter layer/blue-sensitive emulsion layer unit (including three layers in the order of a low-speed blue-sensitive layer/medium-speed blue-sensitive layer/high-speed blue-sensitive layer from the one closest to the support)/first protective layer/second protective layer.

Each of the first, second, and third interlayers can be a single layer or two or more layers. These interlayers can contain couplers and DIR compounds, etc., such as those which is described in JP-A's-61-43738, 59-113438, 59-113440, 61-20037 and 61-20038, and further, a color color-mixing preventing agent to be used usually.

Also, the protective layer preferably has a three-layered configuration including first to third protective layers. When the protective layer includes two or three layers, the second protective layer preferably contains a fine-grain silver halide having an average equivalent-sphere grain size of 0.10 $\mu$m or less. This silver halide is preferably silver bromide or silver iodobromide.

Although the silver halide emulsions for use in the present invention may be combined with emulsions containing light-sensitive silver halide grains of configuration falling outside the scope of the present invention, it is preferred that the emulsion containing grains of 8 or greater (more preferably 10 or greater) average aspect ratio be used, in terms of silver, of 30% or more by weight (more preferably 60% or more by weight) to the total amount of silver halide grains contained in the photosensitive material. Alternatively, it is preferred that the emulsion containing grains having an average equivalent sphere diameter of 0.55 $\mu$m or less (more preferably 0.5 $\mu$m or less) and having an average aspect ratio of 2 or greater (more preferably 3 or greater) be used, in terms of silver, of 30% or more by weight (more preferably 60% or more by weight) to the total amount of silver halide grains contained in the photosensitive material.

Still alternatively, it is preferred that the grain, in terms of silver, of the emulsion containing grains of 8 or greater (more preferably 10 or greater) average aspect ratio combined with the emulsion containing grains having an average equivalent sphere diameter of 0.55 $\mu$m or less (more preferably 0.5 $\mu$m or less) and having an average aspect ratio of 2 or greater (more preferably 3 or greater) be 50% or more (more preferably 70% or more) based on the total amount of silver halide grains contained in the photosensitive material.

A silver halide color photographic lightsensitive material of the present invention can have a light-sensitive emulsion layer other than those enumerated above. It is particularly preferable, in respect of color reproduction, to form a light-sensitive emulsion layer spectrally sensitized to a cyan region to give an interlayer effect to a red-sensitive emulsion layer. This layer for imparting an interlayer effect can be blue-, green-, or red-sensitive. As described in U.S. Pat. Nos. 4,663,271, 4,705,744, and 4,707,436, and JP-A's-62-160448 and 63-89850, a donor layer with an interlayer effect, which has a different spectral sensitivity distribution from that of a main sensitive layer such as BL, GL, or RL, is preferably formed adjacent to, or close to, this main sensitive layer.

Applicable various techniques and inorganic and organic materials usable in the silver halide photographic emulsion and silver halide photosensitive material using the same are generally those described in Research Disclosure Item 308119 (1989), Item 37038 (1995), and Item 40145 (1997).

In addition, more specifically, techniques and inorganic and organic materials that can used in the color photosensitive materials of the present invention are described in portions of EP436,938A2 and patents cited below.

| | Items | Corresponding portions |
|---|---|---|
| 1) | Layer configurations | page 146, line 34 to page 147, line 25 |
| 2) | Silver halide emulsions usable together | page 147, line 26 to page 148 line 12 |
| 3) | Yellow couplers usable together | page 137, line 35 to page 146, line 33, and page 149, lines 21 to 23 |
| 4) | Magenta couplers usable together | page 149, lines 24 to 28; EP421, 453A1, page 3, line 5 to page 25, line 55 |
| 5) | Cyan couplers usable together | page 149, lines 29 to 33; EP432, 804A2, page 3, line 28 to page 40, line 2 |
| 6) | Polymer couplers | page 149, lines 34 to 38; EP435, 334A2, page 113, line 39 to page 123, line 37 |
| 7) | Colored couplers | page 53, line 42 to page 137, line 34, and page 149, lines 39 to 45 |
| 8) | Functional couplers usable together | page 7, line 1 to page 53, line 41, and page 149, line 46 to page 150, line 3; EP435, 334A2, page 3, line 1 to page 29, line 50 |
| 9) | Antiseptic and mildewproofing agents | page 150, lines 25 to 28 |
| 10) | Formalin scavengers | page 149, lines 15 to 17 |
| 11) | Other additives usable together | page 153, lines 38 to 47; EP421, 453A1, page 75, line 21 to page 84, line 56, and page 27, line 40 to page 37, line 40 |
| 12) | Dispersion methods | page 150, lines 4 to 24 |
| 13) | Supports | page 150, lines 32 to 34 |
| 14) | Film thickness · film physical properties | page 150, lines 35 to 49 |
| 15) | Color development step | page 150, line 50 to page 151, line 47 |
| 16) | Desilvering step | page 151, line 48 to page 152, line 53 |
| 17) | Automatic processor | page 152, line 54 to page 153, line 2 |

-continued

| | Items | Corresponding portions |
|---|---|---|
| 18) | Washing · stabilizing step | page 153, lines 3 to 37 |

When the present invention is applied to a silver halide color photosensitive material, examples of image-forming couplers to be used include those mentioned below:

Yellow Couplers:

couplers represented by formulas (I) and (II) in EP502,424A;

couplers (particularly Y-28 on page 18) represented by formulas (1) and (2) in European Patent (hereinafter referred to as "EP") 513,496A;

couplers represented by formula (I) in claim 1 of EP568,037A;

couplers represented by formula (I) in column 1, lines 45 to 55 of U.S. Pat. No. 5,066,576;

couplers represented by formula (I) in paragraph 0008 of JP-A-4-274425;

couplers (particularly D-35) described in claim 1 on page 40 of EP498,381A1;

couplers (particularly Y-1 and Y-54) represented by formula (Y) on page 4 of EP447,969A1;

couplers represented by formulas (II) to (IV) in column 7, lines 36 to 58 of U.S. Pat. No. 4,476,219;

couplers represented by general formula (I) described in JP-A-2002-318442;

couplers represented by general formulas (I) to (IV) described in JP-A-2003-50449;

couplers represented by general formula (I) described in EP 1,246,006A2; and so on Magenta Couplers:

couplers described in JP-A-3-39737 (e.g., L-57, L-68, and L-77);

couplers described in EP456,257 (e.g., A-4-63, and A-4-73 and A-4-75;

couplers described in EP486,965 (e.g., M-4, M-6, and M-7;

couplers described in EP571,959A (e.g., M-45);

couplers described in JP-A-5-204106 (e.g., M-1);

couplers described in JP-A-4-362631 (e.g., M-22);

couplers represented by general formula (MC-1) described in JP-A-11-119393 (e.g., CA-4, CA-7, CA-12, CA-15, CA-16, and CA-18);

couplers represented by formulae (M-I) and (M-II) described in U.S. Pat. No. 6,492,100B2;

couplers represented by formula (I) described in U.S. Pat. No. 6,468,729B2; and so on Cyan Couplers:

couplers described in JP-A-4-204843 (e.g., CX-1, -3, -4, -5, -11, -12, -14, and -15);

couplers described in JP-A-4-43345 (e.g., C-7, -10, -34 and, -35, and (I-1) and (I-17);

couplers represented by formulas (Ia) or (Ib) in claim 1 of JP-A-6-67385;

couplers represented by general formula (PC-1) described in JP-A-11-119393 (e.g., CB-1, CB-4, CB-5, CB-9, CB-34, CB-44, CB-49 and CB-51);

couplers represented by general formula (NC-1) described in JP-A-11-119393 (e.g., CC-1 and CC-17);

couplers represented by general formula (I) described in JP-A-2002-162727; and so on.

EXAMPLE

The present invention will be described by way of Examples, but the present invention is not limited to these.

Example 1

Sample 101 was prepared by coating the following light-sensitive emulsion layers on an undercoated triacetylcellulose support of 127 μm thick. The figures indicate addition amounts per $m^2$. The effects of the compounds added are not limited to those described herein.

Preparation of Coated Sample 101

(i) Preparation of Triacetylcellulose Film

Triacetylcellulose was dissolved (13% by weight) by a common solution casting process in dichloromethane/methanol=92/8 (weight ratio), and triphenyl phosphate and biphenyldiphenyl phosphate in a weight ratio of 2:1, which are plasticizers, were added to the resultant solution so that the total amount of the plasticizers was 14% to the triacetylcellulose. Then, a triacetylcellulose film was made by a band process. The thickness of the support after drying was 97 μm.

(ii) Components of Undercoat Layer

The two surfaces of the triacetylcellulose film were subjected to the following undercoat. The figures indicate weight contained per liter of the undercoat solution.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

(iii) Coating of Back Layers

One surface of the undercoated support was coated with the following back layers.

1st Layer

| | |
|---|---|
| Binder: acid-processed gelatin (isoelectric point: 9.0) | 1.00 g |
| Polymeric latex: P-2 (average grain size: 0.1 μm) | 0.13 g |
| Polymeric latex: P-4 (average grain size 0.2 μm) | 0.23 g |
| Ultraviolet absorbent U-1 | 0.030 g |
| Ultraviolet absorbent U-2 | 0.010 g |
| Ultraviolet absorbent U-3 | 0.010 g |
| Ultraviolet absorbent U-4 | 0.020 g |
| High-boiling organic solvent Oil-2 | 0.030 g |
| Surfactant W-2 | 0.010 g |
| Surfactant W-4 | 3.0 mg |

2nd Layer

| | |
|---|---|
| Binder: acid-processed gelatin (isoelectric point: 9.0) | 3.10 g |
| Polymeric latex: P-4 (average grain size: 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-2 | 0.010 g |
| Surfactant W-4 | 3.0 mg |
| Dye D-2 | 0.10 g |
| Dye D-10 | 0.12 g |

-continued

| | |
|---|---|
| Potassium sulfate | 0.25 g |
| Calcium chloride | 0.5 mg |
| Sodium hydroxide | 0.03 g |

3rd Layer

| | |
|---|---|
| Binder: acid-processed gelatin (isoelectric point: 9.0) | 3.30 g |
| Surfactant W-2 | 0.020 g |
| Potassium sulfate | 0.30 g |
| Sodium hydroxide | 0.03 g |

4th Layer

| | |
|---|---|
| Binder: lime-processed gelatin (isoelectric point: 5.4) | 1.15 g |
| 1:9 copolymer of methacrylic acid and methylmethacrylate (average grain size: 2.0 μm) | 0.040 g |
| 6:4 copolymer of methacrylic acid and methylmethacrylate (average grain size: 2.0 μm) | 0.030 g |
| Surfactant W-2 | 0.060 g |
| Surfactant W-1 | 7.0 mg |
| Hardener II-1 | 0.23 g |

(iv) Coating with Light-sensitive Emulsion Layer

Sample 101 was produced by applying the following light-sensitive emulsion layers onto the side opposite to the back layer coating. The figures indicate addition amounts per $m^2$. The effects of added compounds are not limited to those described herein.

With respect to the following gelatins, use was made of those of 100 thousand to 200 thousand molecular weight (mass average molecular weight). With respect to the contents of major metal ions therein, the content of calcium was in the range of 2500 to 3000 ppm; the content of iron was in the range of 1 to 7 ppm; and the content of sodium was in the range of 1500 to 3000 ppm.

Moreover, gelatin of 1000 ppm or less calcium content was used in combination therewith.

In the formation of each of the layers, the organic compounds to be added were brought into gelatinous emulsified dispersions (surfactant W-3 used, the amount of W-3 indicated in relevant location for each of the layers). Also, the light-sensitive emulsions and yellow colloidal silver were brought into respective gelatinous dispersions. These dispersions were mixed together, thereby obtaining coating liquids so formulated as to realize described addition amounts. The obtained coating liquids were subjected to coating operation. Compounds Cpd-H, O, P and Q and dyes D-1, 2, 3, 5, 6, 8, 9 and 10, H-1, P-3 and F-1 to 9 were dissolved in water or appropriate water miscible organic solvents, such as methanol, dimethylformamide, ethanol and dimethylacetamide, and added to the coating liquids for individual layers.

The coating operation was followed by drying operation through a multi-stage drying process wherein the temperature was maintained within the range of 10 to 45° C. Thus, the desired sample was obtained.

Emulsions A to N among the employed light-sensitive emulsions were prepared as specified in Table 1 in accordance with the teaching of JP-A-4-80751.

1st Layer: Antihalation Layer

| | |
|---|---|
| Black colloidal silver | 0.20 g |
| Gelatin | 2.20 g |
| Compound Cpd-B | 0.010 g |
| Ultraviolet absorber U-1 | 0.050 g |
| Ultraviolet absorber U-3 | 0.020 g |
| Ultraviolet absorber U-4 | 0.020 g |
| Ultraviolet absorber U-5 | 0.010 g |
| Ultraviolet absorber U-2 | 0.070 g |
| Compound Cpd-F | 0.20 g |
| High-boiling organic solvent Oil-2 | 0.020 g |
| High-boiling organic solvent Oil-6 | 0.020 g |
| Dye D-4 | 1.0 mg |
| Dye D-8 | 1.0 mg |
| Microcrystalline solid dispersion of dye E-1 | 0.05 g |
| W-3 | 0.030 g |

2nd Layer: Interlayer

| | |
|---|---|
| Gelatin | 0.4 g |
| Compound Cpd-F | 0.050 g |
| Compound Cpd-R | 0.020 g |
| Compound Cpd-S | 0.020 g |
| High-boiling organic solvent Oil-6 | 0.010 g |
| High-boiling organic solvent Oil-7 | 5.0 mg |
| High-boiling organic solvent Oil-8 | 0.020 g |
| Dye D-11 | 2.0 mg |
| Dye D-7 | 4.0 mg |
| W-3 | 0.010 g |

3rd Layer: Interlayer

| | |
|---|---|
| Gelatin | 0.4 g |

4th Layer: Interlayer

| | |
|---|---|
| Gelatin | 1.50 g |
| Compound Cpd-M | 0.10 g |
| Compound Cpd-D | 0.010 g |
| Compound Cpd-K | 3.0 mg |
| Compound Cpd-O | 3.0 mg |
| Compound Cpd-T | 5.0 mg |
| Ultraviolet absorber U-6 | 0.010 g |
| High-boiling organic solvent Oil-6 | 0.10 g |
| High-boiling organic solvent Oil-3 | 0.010 g |
| High-boiling organic solvent Oil-4 | 0.010 g |
| W-3 | 0.015 g |

5th Layer: Low-speed Red-sensitive Emulsion Layer

| | | |
|---|---|---|
| Emulsion A | silver | 0.20 g |
| Emulsion B | silver | 0.20 g |
| Yellow colloidal silver | silver | 1.0 mg |
| Gelatin | | 0.60 g |
| Coupler C-1 | | 0.15 g |
| Coupler C-2 | | 7.0 mg |
| Ultraviolet absorber U-2 | | 3.0 mg |
| Compound Cpd-J | | 2.0 mg |
| High-boiling organic solvent Oil-5 | | 0.050 g |
| High-boiling organic solvent Oil-10 | | 0.020 g |
| W-3 | | 0.020 g |

6th Layer: Medium-speed Red-sensitive Emulsion Layer

| | | |
|---|---|---|
| Emulsion B | silver | 0.20 g |
| Emulsion C | silver | 0.15 g |
| Silver bromide emulsion with interior fogged (cubic grains, av. equiv. sphere diam. 0.11 μm) | silver | 0.010 g |
| Gelatin | | 0.60 g |
| Coupler C-1 | | 0.15 g |
| Coupler C-2 | | 7.0 mg |
| High-boiling organic solvent Oil-5 | | 0.050 g |
| High-boiling organic solvent Oil-10 | | 0.020 g |
| Compound Cpd-T | | 2.0 mg |
| W-3 | | 0.020 g |

7th Layer: High-speed Red-sensitive Emulsion Layer

| | | |
|---|---|---|
| Emulsion D | silver | 0.35 g |
| Gelatin | | 1.50 g |
| Coupler C-1 | | 0.70 g |
| Coupler C-2 | | 0.025 g |
| Coupler C-3 | | 0.020 g |
| Coupler C-8 | | 3.0 mg |
| Ultraviolet absorber U-1 | | 0.010 g |
| High-boiling organic solvent Oil-5 | | 0.25 g |
| High-boiling organic solvent Oil-9 | | 0.05 g |
| High-boiling organic solvent Oil-10 | | 0.10 g |
| Compound Cpd-D | | 3.0 mg |
| Compound Cpd-L | | 1.0 mg |
| Compound Cpd-T | | 0.050 g |
| Additive P-1 | | 0.010 g |
| Additive P-3 | | 0.010 g |
| Dye D-8 | | 1.0 mg |
| W-3 | | 0.090 g |

8th Layer: Interlayer

| | | |
|---|---|---|
| Gelatin | | 0.50 g |
| Additive P-2 | | 0.030 g |
| Dye D-5 | | 0.010 g |
| Dye D-9 | | 6.0 mg |
| Compound Cpd-I | | 0.020 g |
| Compound Cpd-O | | 3.0 mg |
| Compound Cpd-P | | 5.0 mg |

9th Layer: Interlayer

| | | |
|---|---|---|
| Yellow colloidal silver | silver | 3.0 mg |
| Gelatin | | 1.00 g |
| Additive P-2 | | 0.010 g |
| Compound Cpd-A | | 0.030 g |
| Compound Cpd-M | | 0.10 g |
| Compound Cpd-O | | 2.0 mg |
| Ultraviolet absorber U-1 | | 0.010 g |
| Ultraviolet absorber U-2 | | 0.010 g |
| Ultraviolet absorber U-5 | | 5.0 mg |
| High-boiling organic solvent Oil-3 | | 0.010 g |
| High-boiling organic solvent Oil-6 | | 0.10 g |
| W-3 | | 0.020 g |

10th Layer: Low-speed Green-sensitive Emulsion Layer

| | | |
|---|---|---|
| Emulsion E | silver | 0.15 g |
| Emulsion F | silver | 0.15 g |
| Emulsion G | silver | 0.15 g |
| Gelatin | | 1.00 g |

-continued

| | | |
|---|---|---|
| Coupler C-4 | | 0.060 g |
| Coupler C-5 | | 0.10 g |
| Compound Cpd-B | | 0.020 g |
| Compound Cpd-G | | 2.5 mg |
| Compound Cpd-K | | 1.0 mg |
| High-boiling organic solvent Oil-2 | | 0.010 g |
| High-boiling organic solvent Oil-5 | | 0.020 g |
| W-3 | | 0.010 g |

11th Layer: Medium-speed Green-sensitive Emulsion Layer

| | | |
|---|---|---|
| Emulsion G | silver | 0.20 g |
| Emulsion H | silver | 0.10 g |
| Gelatin | | 0.50 g |
| Coupler C-4 | | 0.10 g |
| Coupler C-5 | | 0.050 g |
| Coupler C-6 | | 0.010 g |
| Compound Cpd-B | | 0.020 g |
| Compound Cpd-U | | 8.0 mg |
| High-boiling organic solvent Oil-2 | | 0.010 g |
| High-boiling organic solvent Oil-5 | | 0.020 g |
| Additive P-1 | | 0.010 g |
| W-3 | | 0.015 g |

12th Layer: High-speed Green-sensitive Emulsion Layer

| | | |
|---|---|---|
| Emulsion I | silver | 0.40 g |
| Silver bromide emulsion with interior foggeed (cubic grains, av. equiv. sphere diam. 0.11 μm) | silver | 5.0 mg |
| Gelatin | | 1.20 g |
| Coupler C-4 | | 0.50 g |
| Coupler C-5 | | 0.20 g |
| Coupler C-7 | | 0.10 g |
| Compound Cpd-B | | 0.030 g |
| Compound Cpd-U | | 0.020 g |
| High-boiling organic solvent Oil-5 | | 0.15 g |
| Additive P-1 | | 0.030 g |
| W-3 | | 0.050 g |

13th Layer: Yellow Filter Layer

| | | |
|---|---|---|
| Yellow colloidal silver | silver | 2. 0 mg |
| Gelatin | | 1.0 g |
| Compound Cpd-C | | 0.010 g |
| Compound Cpd-M | | 0.020 g |
| High-boiling organic solvent Oil-1 | | 0.020 g |
| High-boiling organic solvent Oil-6 | | 0.020 g |
| Microcrystalline solid dispersion of dye E-2 | | 0.25 g |
| W-3 | | 6.0 mg |

14th Layer: Low-speed Blue-sensitive Emulsion Layer

| | | |
|---|---|---|
| Emulsion J | silver | 0.15 g |
| Emulsion K | silver | 0.10 g |
| Emulsion L | silver | 0.15 g |
| Silver bromide emulsion with surface and interior fogged (cubic grains, av. equiv. sphere diam. 0.11 μm) | silver | 0.010 g |
| Gelatin | | 0.80 g |
| Coupler C-8 | | 0.020 g |
| Coupler C-9 | | 0.020 g |
| Coupler C-10 | | 0.20 g |
| Compound Cpd-B | | 0.010 g |
| Compound Cpd-I | | 8.0 mg |
| Compound Cpd-K | | 2.0 mg |
| Ultraviolet absorber U-5 | | 0.010 g |

-continued

| | | |
|---|---|---|
| Additive P-1 | | 0.020 g |
| W-3 | | 0.025 g |

15th Layer: Medium-speed Blue-sensitive Emulsion Layer

| | | |
|---|---|---|
| Emulsion L | silver | 0.20 g |
| Emulsion M | silver | 0.20 g |
| Gelatin | | 0.80 g |
| Coupler C-8 | | 0.030 g |
| Coupler C-9 | | 0.030 g |
| Coupler C-10 | | 0.30 g |
| Compound Cpd-B | | 0.015 g |
| Compound Cpd-E | | 0.020 g |
| Compound Cpd-N | | 2.0 mg |
| Compound Cpd-T | | 0.010 g |
| Ultraviolet absorber U-5 | | 0.015 g |
| Additive P-1 | | 0.030 g |
| W-3 | | 0.035 g |

16th Layer: High-speed Blue-sensitive Emulsion Layer

| | | |
|---|---|---|
| Emulsion N | silver | 0.35 g |
| Gelatin | | 2.00 g |
| Coupler C-8 | | 0.10 g |
| Coupler C-9 | | 0.15 g |
| Coupler C-10 | | 1.10 g |
| Coupler C-3 | | 0.010 g |
| High-boiling organic solvent Oil-5 | | 0.020 g |
| Compound Cpd-B | | 0.060 g |
| Compound Cpd-D | | 3.0 mg |
| Compound Cpd-E | | 0.020 g |
| Compound Cpd-F | | 0.020 g |
| Compound Cpd-N | | 5.0 mg |
| Compound Cpd-T | | 0.070 g |
| Ultraviolet absorber U-5 | | 0.060 g |
| Additive P-1 | | 0.10 g |
| W-3 | | 0.17 g |

17th Layer: 1st Protective Layer

| | |
|---|---|
| Gelatin | 0.70 g |
| Ultraviolet absorber U-1 | 0.020 g |
| Ultraviolet absorber U-5 | 0.030 g |
| Ultraviolet absorber U-2 | 0.10 g |
| Compound Cpd-B | 0.030 g |

-continued

| | |
|---|---|
| Compound Cpd-O | 5.0 mg |
| Compound Cpd-A | 0.030 g |
| Compound Cpd-H | 0.20 g |
| Dye D-1 | 2.0 mg |
| Dye D-2 | 3.0 mg |
| Dye D-3 | 2.0 mg |
| Dye D-6 | 2.0 mg |
| High-boiling organic solvent Oil-2 | 0.020 g |
| High-boiling organic solvent Oil-3 | 0.030 g |
| W-3 | 0.15 g |

18th Layer: 2nd Protective Layer

| | | |
|---|---|---|
| Fine-grain silver iodobromide emulsion (av. equiv. sphere diam. 0.06 μm, silver iodide content 1 mol %) | silver | 0.10 g |
| Gelatin | | 0.80 g |
| Ultraviolet absorber U-2 | | 0.030 g |
| Ultraviolet absorber U-5 | | 0.030 g |
| High-boiling organic solvent Oil-2 | | 0.010 g |
| W-3 | | 6.0 mg |

19th Layer: 3rd Protective Layer

| | |
|---|---|
| Gelatin | 1.00 g |
| Polymethyl methacrylate (av. particle diam. 1.5 μm) | 0.10 g |
| Methyl methacrylate/methacrylic acid 6:4 copolymer (av. particle diam. 1.5 μm) | 0.15 g |
| Silicone oil SO-1 | 0.20 g |
| Surfactant W-1 | 0.010 g |
| Surfactant W-2 | 0.040 g |

In addition to the above compositions, additives F-1 to F-9 were added to all the above emulsion layers. Furthermore, in addition to the above compositions, gelatin hardener H-1 and surfactants for coating W-2 and W-4 were added to each of the above layers.

Still further, phenol, 1,2-benzisothiazolin-3-one, 2-phenoxyethanol, phenethyl alcohol and butyl p-benzoate were added as antiseptics and mildewproofing agents.

The thus obtained sample 101 exhibited a coating layer thickness, measured in the dry state, of 23.3 μm and a swell ratio, measured upon swelling with distilled water at 25° C., of 1.75.

TABLE 1

| Constitution of silver halide emulsion | | | | | | | | | | | |
|---|---|---|---|---|---|---|---|---|---|---|---|
| Silver iodobromide emulsion used in Sample 101 | | | | | | | | | | | |
| | | Av. ESD | | Av. AgI content | Structure in halide composition of silver halide | Average AgI content at grain surface | Other characteristics | | | | |
| Emulsion | Characteristics | (μm) | COV (%) | (mol %) | grains | (mol %) | (1) | (2) | (3) | (4) | (5) |
| A | Monodisperse tetradecahedral grains | 0.25 | 16 | 3.7 | Triple structure | 2.5 | | ○ | | | |
| B | Monodisperse cubic internally fogged grains | 0.30 | 10 | 3.3 | Quadruple structure | 1.5 | | | ○ | ○ | |

TABLE 1-continued

| | Constitution of silver halide emulsion | | | | | | | | | | |
|---|---|---|---|---|---|---|---|---|---|---|---|
| | Silver iodobromide emulsion used in Sample 101 | | | | | | | | | | |
| | | Av. ESD | | Av. AgI content | Structure in halide composition of silver halide | Average AgI content at grain surface | Other characteristics | | | | |
| Emulsion | Characteristics | (μm) | COV (%) | (mol %) | grains | (mol %) | (1) | (2) | (3) | (4) | (5) |
| C | Monodisperse tetradecahedral grains | 0.30 | 18 | 5.0 | Triple structure | 2.1 | | ○ | | | |
| D | Polydisperse tabular grains Av. aspect ratio 5.0 | 0.60 | 25 | 2.0 | Triple structure | 1.0 | | ○ | | | ○ |
| E | Monodisperse cubic grains | 0.17 | 17 | 4.0 | Triple structure | 1.3 | ○ | | | | |
| F | Monodisperse cubic grains | 0.20 | 16 | 4.0 | Quadruple structure | 2.5 | | ○ | | | |
| G | Monodisperse cubic internally fogged grains | 0.25 | 11 | 3.5 | Quadruple structure | 1.5 | ○ | ○ | | ○ | |
| H | Monodisperse cubic internally fogged grains | 0.30 | 9 | 3.5 | Quadruple structure | 0.9 | | ○ | | ○ | |
| I | Polydisperse tabular grains Av. aspect ratio 4.0 | 0.80 | 28 | 1.5 | Triple structure | 1.0 | ○ | ○ | | | ○ |
| J | Monodisperse tetradecahedral grains | 0.30 | 18 | 4.0 | Triple structure | 2.8 | | | ○ | | |
| K | Monodisperse tetradecahedral grains | 0.37 | 17 | 4.0 | Triple structure | 2.5 | | ○ | | | |
| L | Monodisperse cubic internally fogged grains | 0.46 | 14 | 3.5 | Quadruple structure | 0.9 | | ○ | | ○ | |
| M | Monodisperse cubic grains | 0.55 | 13 | 1.3 | Triple structure | 1.8 | | ○ | | | |
| N | Polydisperse tabular grains Av. aspect ratio 7.0 | 1.00 | 33 | 1.3 | Triple structure | 1.0 | ○ | ○ | | | ○ |

Av. ESD = Equivalent sphere average grain diameter;
COV = Coefficient of variation
(Other characteristics)
The mark "○" means each of the conditions set forth below is satisfied.
(1) A reduction sensitizer was added during grain formation.
(2) A selenium sensitizer was used as an after-ripening agent.
(3) A rhodium salt was added during grain formation.
(4) A shell was provided subsequent to after-ripening by using silver nitrate in an amount of 10%, in terms of silver molar ratio, of the emulsion grains at that time, together with the equimolar amount of potassium bromide.
(5) The presence of dislocation lines in an average number of ten or more per grain was observed by a transmission electron microscope.
Note that all the lightsensitive emulsions were after-ripped by the use of sodium thiosulfate, potassium thiocyanate, and sodium aurichloride. Note, also, a iridium salt was added during grain formation. Note, also, that chemically-modified gelatin whose amino groups were partially converted to phthalic acid amide, was added to emulsions B, C, E, H, J and N.

TABLE 2

| Spectral sensitization of emulsions A–N | | | |
|---|---|---|---|
| Emulsion | Spectral sensitizing dye added | Addition amount per mol of silver halide (g) | Timing at which the sensitizing dye was added |
| A | S-1 | 0.025 | Immediately after chemical sensitization |
| | S-2 | 0.25 | " |
| B | S-1 | 0.01 | Immediately after completion of grain formation |
| | S-2 | 0.25 | Immediately after completion of grain formation |
| C | S-1 | 0.02 | Immediately after chemical sensitization |
| | S-2 | 0.25 | " |
| D | S-1 | 0.01 | Immediately after chemical sensitization |
| | S-2 | 0.10 | " |
| | S-7 | 0.01 | " |

TABLE 2-continued

Spectral sensitization of emulsions A–N

| Emulsion | Spectral sensitizing dye added | Addition amount per mol of silver halide (g) | Timing at which the sensitizing dye was added |
|---|---|---|---|
| E | S-3 | 0.5 | Immediately after chemical sensitization |
| | S-4 | 0.1 | " |
| F | S-3 | 0.3 | Immediately after chemical sensitization |
| | S-4 | 0.1 | " |
| G | S-3 | 0.25 | Immediately after completion of grain formation |
| | S-4 | 0.08 | Immediately after completion of grain formation |
| H | S-3 | 0.2 | During grain formation |
| | S-4 | 0.06 | " |
| I | S-3 | 0.3 | Immediately before the initiation of chemical sensitization |
| | S-4 | 0.06 | Immediately before the initiation of chemical sensitization |
| | S-8 | 0.1 | Immediately before the initiation of chemical sensitization |
| J | S-6 | 0.2 | During grain formation |
| | S-5 | 0.05 | " |
| K | S-6 | 0.2 | During grain formation |
| | S-5 | 0.05 | " |
| L | S-6 | 0.22 | Immediately after completion of grain formation |
| | S-5 | 0.06 | Immediately after completion of grain formation |
| M | S-6 | 0.15 | Immediately after chemical sensitization |
| | S-5 | 0.04 | " |
| N | S-6 | 0.22 | Immediately after completion of grain formation |
| | S-5 | 0.06 | Immediately after completion of grain formation |

C-1

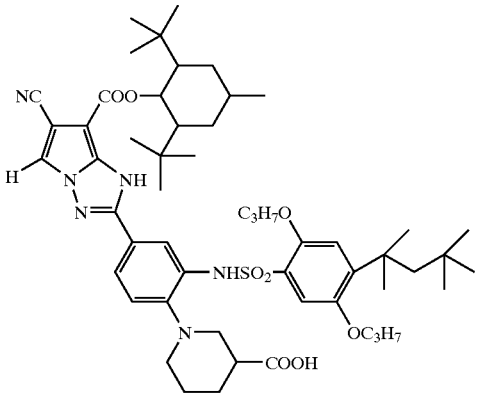

C-2

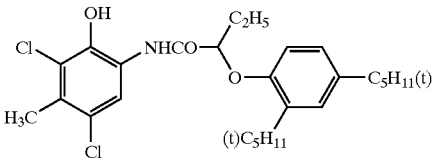

C-3

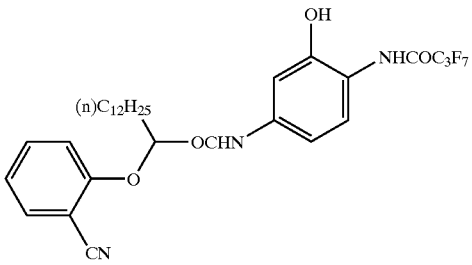

C-4

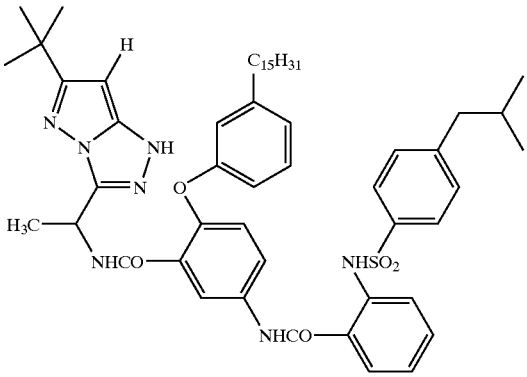

-continued
C-5
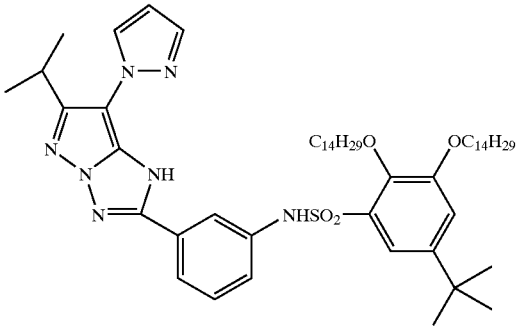
C-6
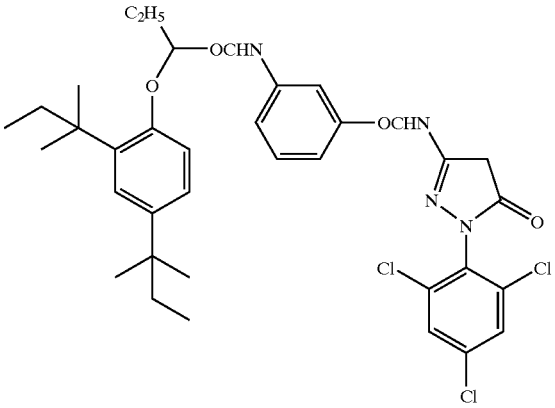
C-7
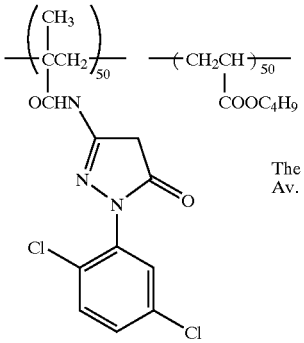
The figures indicate eight %
Av. molecular wt.: about 25,000
C-8
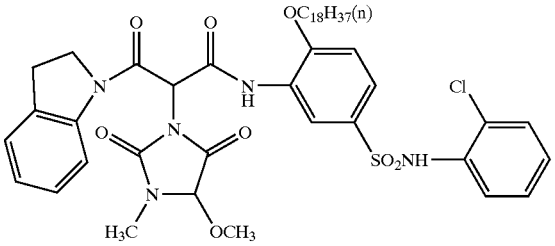
C-9
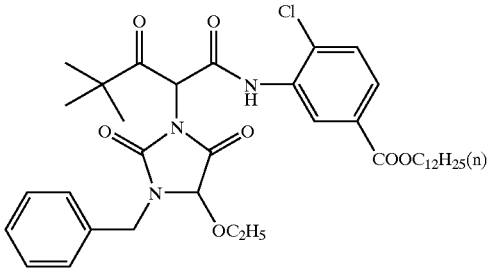
C-10
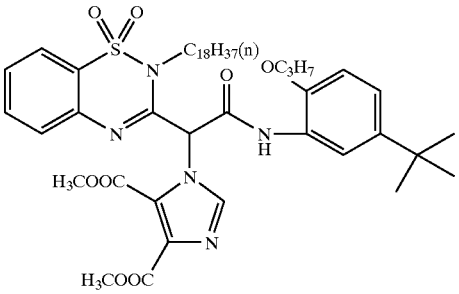
Oil-1
Trin-hexyl phosphate
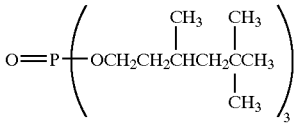
Oil-2
Tricresyl phosphate
Oil-3
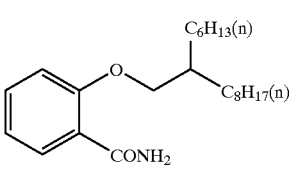
Oil-4
Tricyclohesyl phosphate
Oil-5
Oil-6
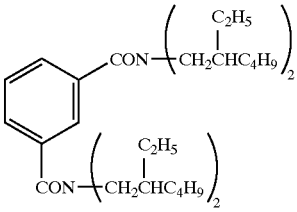

-continued
Oil-7
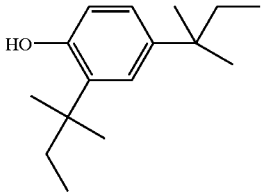
Oil-8
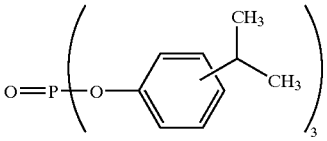
A mixture of isomers
Oil-9
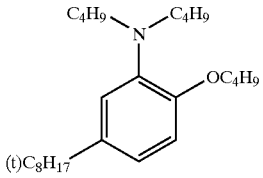
Oil-10
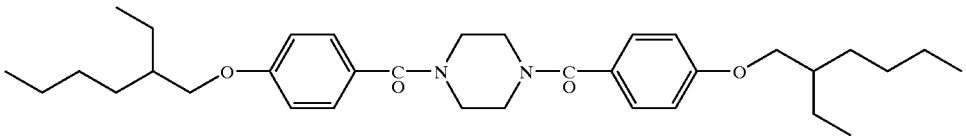
Cpd-A
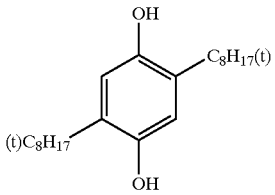
Cpd-B
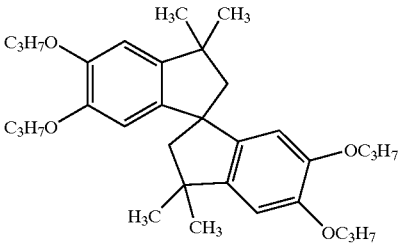
Cpd-C
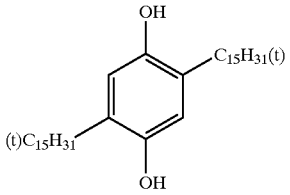
Cpd-D
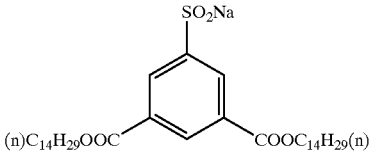
Cpd-E
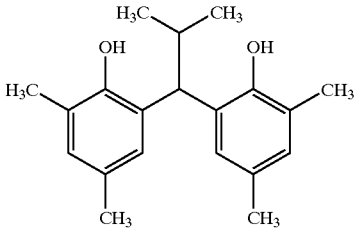
Cpd-F
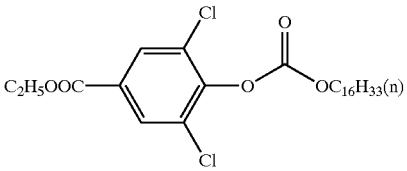
Cpd-G
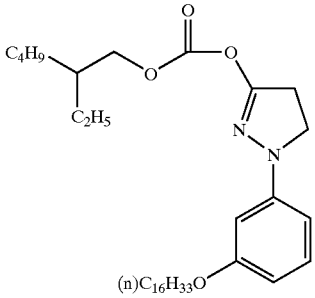
Cpd-H
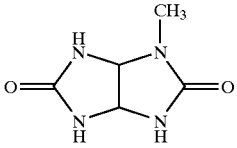

-continued
Cpd-I
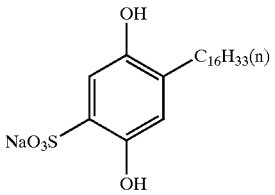
Cpd-J
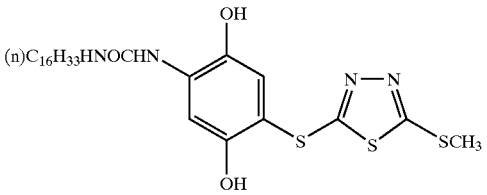
Cpd-K
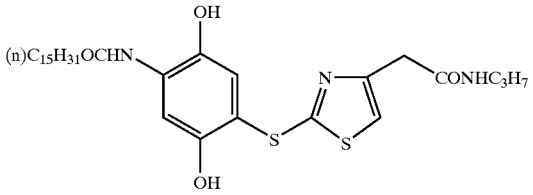
Cpd-L
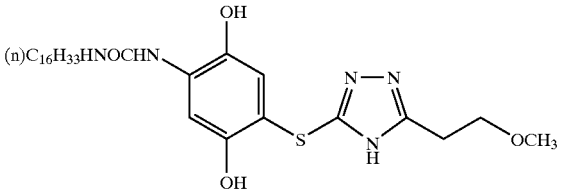
Cpd-M
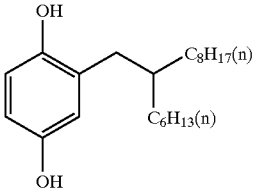
Cpd-N
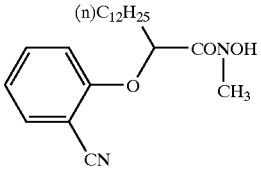
Cpd-O
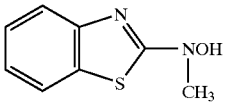
Cpd-P
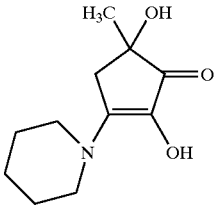
Cpd-Q
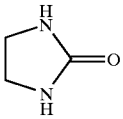
Cpd-R
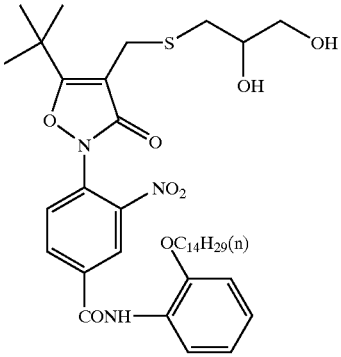
Cpd-S
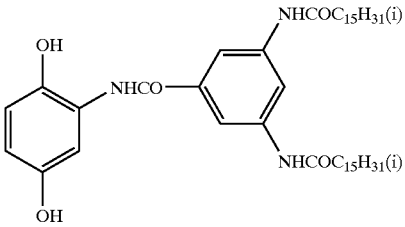
Cpd-T
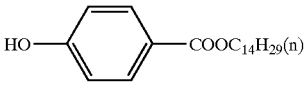

-continued
Cpd-U
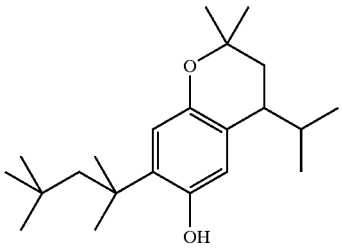
U-1
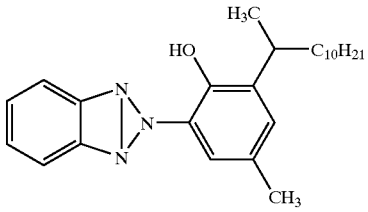
U-2
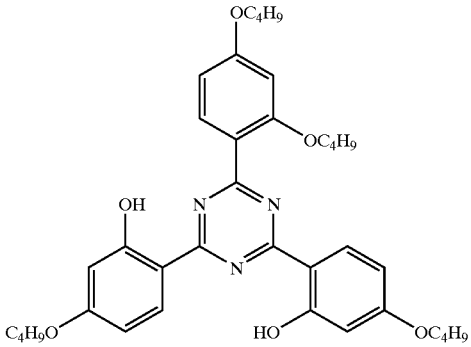
U-3
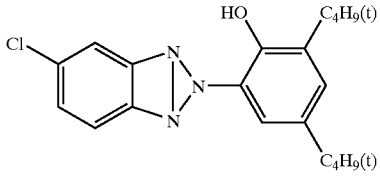
U-4
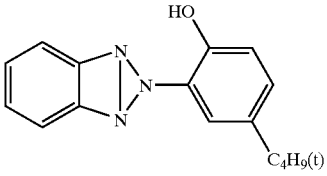
U-5
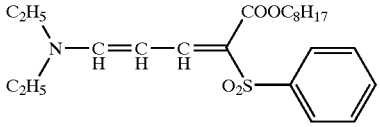
U-6
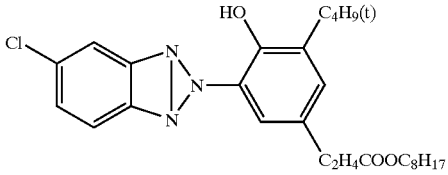
S-1
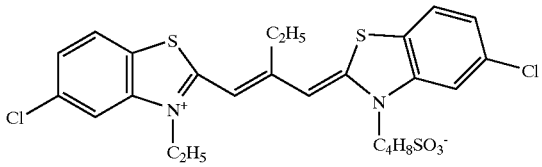
S-2
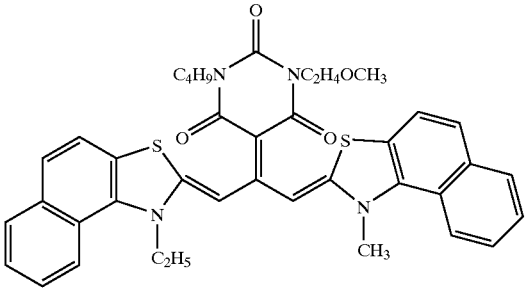
S-3
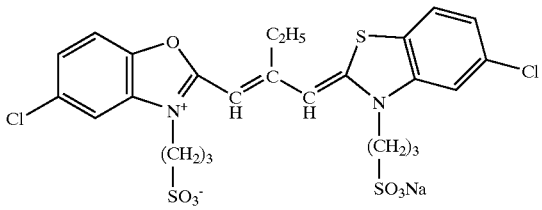
S-4
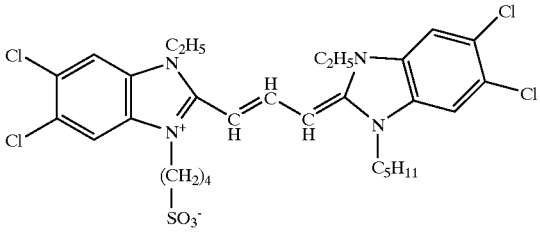
S-5
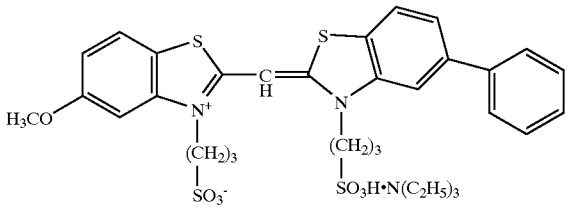

-continued
S-6
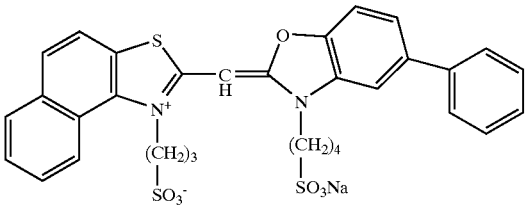
S-7
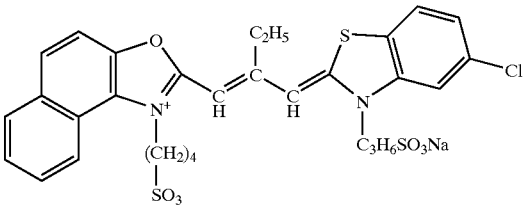
S-8
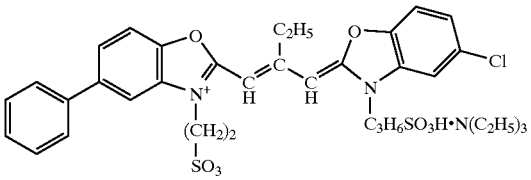
S-9
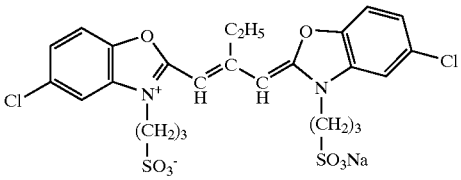
The same compound as S-3
S-10
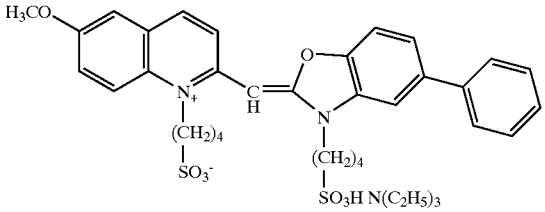
S-11
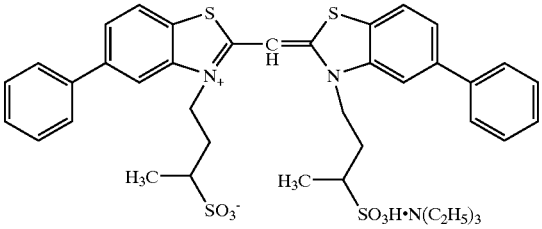
S-12
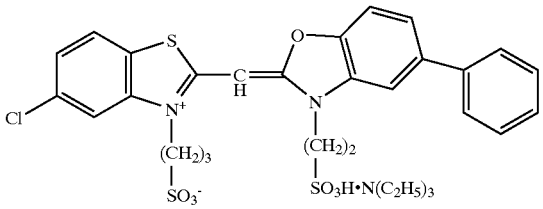
S-13
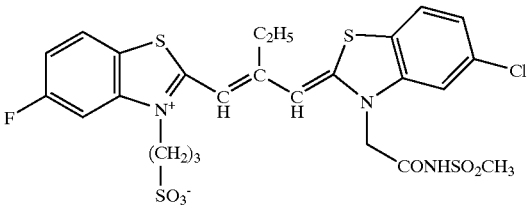
S-14
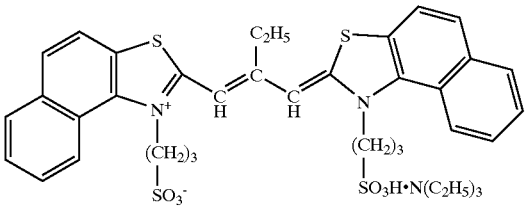
D-1
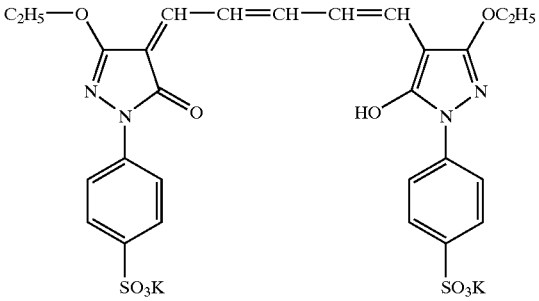
D-2
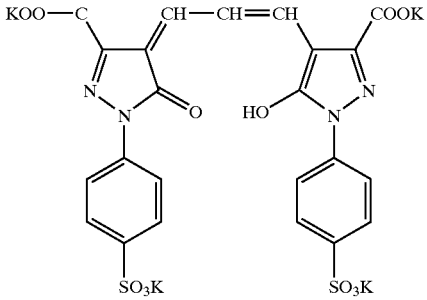
D-3
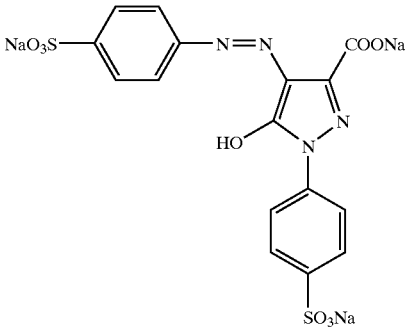

-continued
D-4
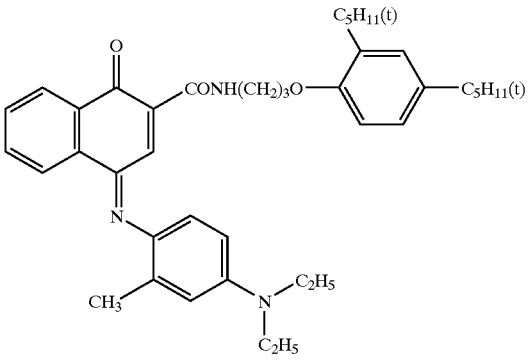
D-5
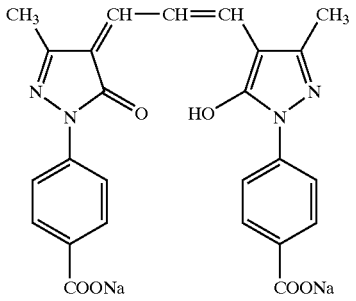
D-6
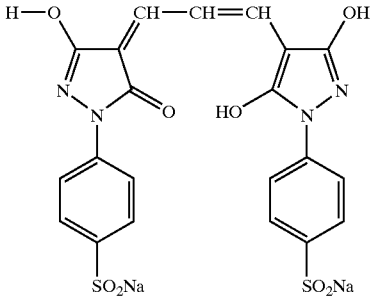
D-7
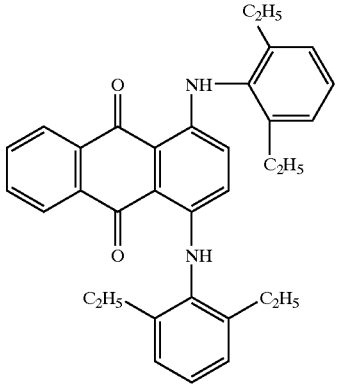
D-8
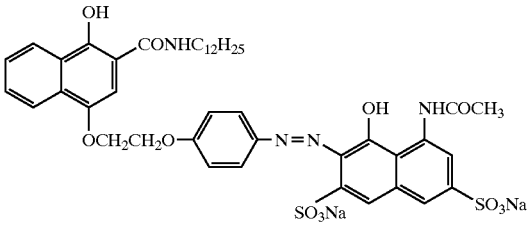
D-9
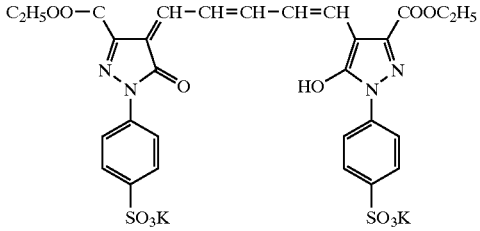
D-10
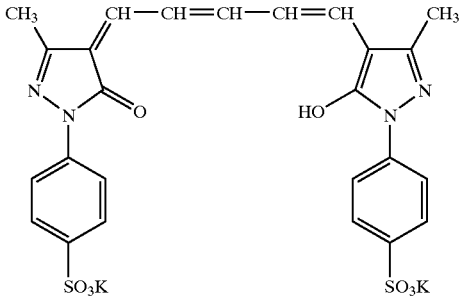
D-11
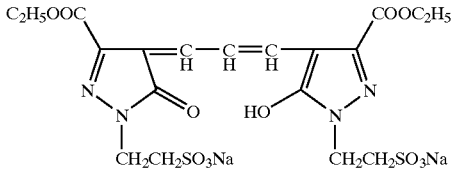
E-1
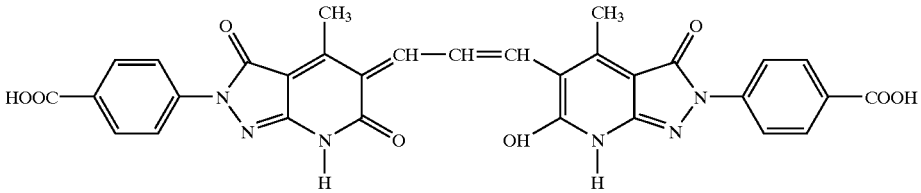

-continued
E-2
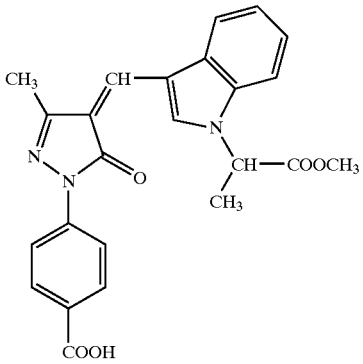
H-1
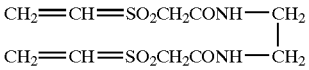
W-1
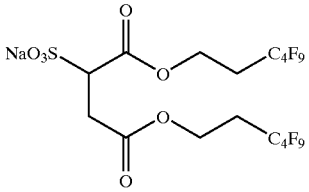
W-2
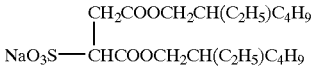
W-3
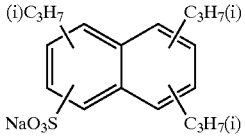
W-4
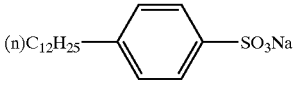
W-5
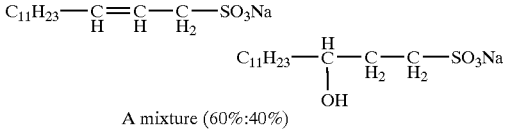
A mixture (60%:40%)
P-1
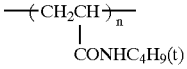
n = 100–1000
P-2
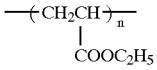
n = 100–1000
P-3
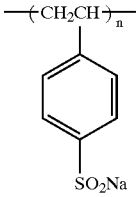
n = 100–1000
P-4
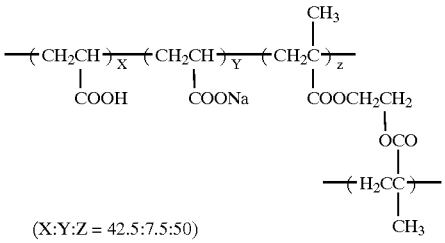
(X:Y:Z = 42.5:7.5:50)
F-1
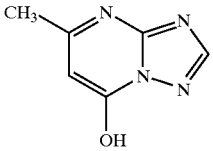
F-2
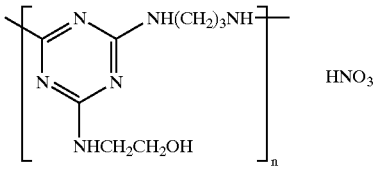
n = 3~4
F-3
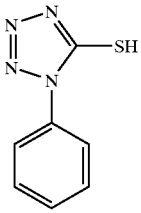

-continued

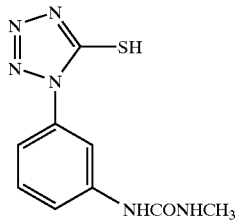

F-4

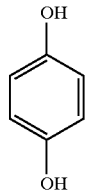

F-5

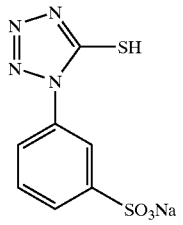

F-6

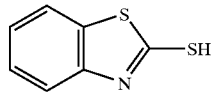

F-7

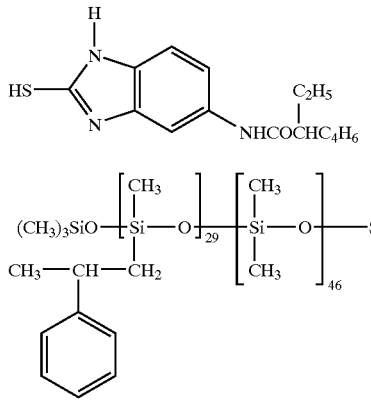

F-8

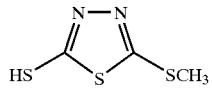

F-9

SO-1

Preparation of Organic Solid Dispersed Dye (Preparation of Fine Crystalline Solid Dispersion of Dye E-1)

15 g of W-5 and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 2 hr. The beads were filtered out, and water was added to dilute the material to a dye concentration of 3%. After that, the material was heated to 90° C. for 10 hr for stabilization. The average grain size of the obtained fine dye grains was 0.30 $\mu$m, and the grain size distribution (grain size standard deviation×100/average grain size) was 20%.

(Preparation of Fine Crystalline Solid Dispersion of Dye E-2)

Water and 270 g of W-4 were added to 1,400 g of a wet cake of E-2 containing 30 weight % of water, and the resultant material was stirred to form a slurry having an E-2 concentration of 40 weight %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr, thereby obtaining a solid fine-grain dispersion of E-2. This dispersion was diluted to 20 weight % by ion exchange water to obtain a fine crystalline solid dispersion. The average grain size was 0.15 $\mu$m.

Samples 102 to 118 were prepared in the same manner as in the preparation of sample 101 except that the light-sensitive emulsions A to N employed in the sample 101 layers and the surfactant W-3 employed in the emulsification dispersion therefor were replaced with those specified in Table 8. The emulsions A4 to N4 were prepared in the same manner as in the preparation of emulsions A to N except that the addition amount of sensitizing dyes was changed as specified in Table 7. In the substitution, each of the light-sensitive emulsions was used, in terms of silver weight, equal to that of corresponding emulsion A to N, and each of the surfactants was used in an amount equimolar to that of surfactant W-3.

TABLE 3

Light-sensitive emulsion used in the invention (All are silver iodobromide grains)

| Emulsion | Characteristics | Av. ESD (μm) | COV (%) | Av. AgI content (mol %) | Structure in halide composition of silver halide grains | Average AgI content at grain surface (mol %) | Other characteristics (1) | (2) | (3) | (4) | (5) | (6) |
|---|---|---|---|---|---|---|---|---|---|---|---|---|
| A2 | Monodisperse (111) tabular grains Av. aspect ratio 11.0 | 0.25 | 18 | 3.0 | Triple structure | 2.5 | | ○ | | | | ○ |
| B2 | Monodisperse (111) tabular grains Av. aspect ratio 13.0 | 0.30 | 16 | 3.3 | Double structure | 1.5 | | ○ | ○ | | | ○ |
| C2 | Monodisperse (111) tabular grains Av. aspect ratio 14.0 | 0.30 | 19 | 3.5 | Triple structure | 2.1 | | ○ | | | | ○ |
| D2 | Monodisperse (111) tabular grains Av. aspect ratio 20.0 | 0.60 | 18 | 2.0 | Triple structure | 1.0 | | ○ | | | ○ | |
| E2 | Monodisperse (111) tabular grains Av. aspect ratio 11.0 | 0.20 | 15 | 4.0 | Triple structure | 1.8 | ○ | | | | | ○ |
| F2 | Monodisperse (111) tabular grains Av. aspect ratio 15.0 | 0.23 | 13 | 4.0 | Double structure | 2.9 | | ○ | ○ | | | ○ |
| G2 | Monodisperse (111) tabular grains Av. aspect ratio 18.0 | 0.25 | 15 | 3.5 | Double structure | 2.5 | ○ | ○ | | | | ○ |
| H2 | Monodisperse (111) tabular grains Av. aspect ratio 21.0 | 0.30 | 14 | 2.8 | Triple structure | 1.9 | | ○ | | | | ○ |
| I2 | Monodisperse (111) tabular grains Av. aspect ratio 20.0 | 0.80 | 19 | 2.4 | Triple structure | 1.0 | ○ | ○ | | ○ | ○ | |
| J2 | Monodisperse (111) tabular grains Av. aspect ratio 16.0 | 0.30 | 18 | 2.7 | Triple structure | 2.8 | ○ | | ○ | | | ○ |
| K2 | Monodisperse (111) tabular grains Av. aspect ratio 15.0 | 0.37 | 15 | 3.5 | Triple structure | 2.5 | | ○ | | | | ○ |
| L2 | Monodisperse (111) tabular grains Av. aspect ratio 20.0 | 0.46 | 12 | 2.5 | Quadruple structure | 1.7 | ○ | ○ | | | | ○ |
| M2 | Monodisperse (111) tabular grains Av. aspect ratio 11.0 | 0.55 | 14 | 1.3 | Quintuple structure | 1.8 | ○ | ○ | | ○ | ○ | |
| N2 | Monodisperse (111) tabular grains Av. aspect ratio 13.0 | 1.00 | 18 | 1.3 | Triple structure | 1.0 | ○ | ○ | | | ○ | |

Av. ESD = Equivalent sphere average grain diameter;
COV = Coefficient of variation
(Other characteristics)
The mark "○" means each of the conditions set forth below is satisfied.
(1) to (5) are as mentioned above in Table 1.
(6) Grains having a protrusion on at least one of the apexes of a tabular grain.

TABLE 4

Spectral sensitization of emulsions A2 to N2

| Emulsion | Spectral sensitizing dye added | Addition amount per mol of silver halide (g) | Timing at which the sensitizing dye was added |
|---|---|---|---|
| A2 | S-1 | 0.1 | During grain formation |
| | S-2 | 1.0 | " |
| B2 | S-1 | 0.5 | During grain formation |
| | S-2 | 1.1 | " |
| C2 | S-1 | 0.1 | During grain formation |
| | S-2 | 1.0 | " |
| D2 | S-1 | 0.05 | Immediately after chemical sensitization |
| | S-2 | 0.8 | " |
| | S-7 | 0.3 | " |

TABLE 4-continued

Spectral sensitization of emulsions A2 to N2

| Emulsion | Spectral sensitizing dye added | Addition amount per mol of silver halide (g) | Timing at which the sensitizing dye was added |
|---|---|---|---|
| E2 | S-3 | 1.2 | During grain formation |
| | S-4 | 0.3 | " |
| F2 | S-3 | 1.1 | During grain formation |
| | S-4 | 0.3 | " |
| G2 | S-3 | 1.2 | During grain formation |
| | S-4 | 0.5 | " |
| H2 | S-3 | 1.0 | During grain formation |
| | S-4 | 0.3 | " |
| I2 | S-3 | 1.2 | Immediately before the initiation of chemical sensitization |
| | S-4 | 0.4 | Immediately before the initiation of chemical sensitization |
| | S-8 | 0.3 | Immediately before the initiation of chemical sensitization |
| J2 | S-6 | 1.0 | During grain formation |
| | S-5 | 0.4 | " |
| K2 | S-6 | 1.2 | During grain formation |
| | S-5 | 0.6 | " |
| L2 | S-6 | 0.8 | During grain formation |
| | S-5 | 0.4 | " |
| M2 | S-6 | 0.9 | Immediately after chemical sensitization |
| | S-5 | 0.6 | " |
| N2 | S-6 | 1.2 | Immediately after completion of grain formation |
| | S-5 | 0.4 | Immediately after completion of grain formation |

Table 5 Light-sensitive emulsion used in the samples (All are silver iodobromide grains)

| Emulsion | Characteristics | Av. ESD (μm) | COV (%) | Av. AgI content (mol %) | Structure in halide composition of silver halide grains | Average AgI content at grain surface (mol %) | Other characteristics (1) | (2) | (3) | (4) | (5) | (6) |
|---|---|---|---|---|---|---|---|---|---|---|---|---|
| A3 | Monodisperse (111) tabular grains Av. aspect ratio 3.0 | 0.25 | 13 | 3.3 | Triple structure | 2.5 | | ○ | | | ○ | |
| B3 | Monodisperse (111) tabular grains Av. aspect ratio 3.0 | 0.30 | 15 | 3.3 | Quadruple structure | 1.5 | | ○ | ○ | ○ | ○ | |
| C3 | Monodisperse (111) tabular grains Av. aspect ratio 4.0 | 0.30 | 13 | 3.5 | Triple structure | 2.8 | | ○ | | | | ○ |
| E3 | Monodisperse (111) tabular grains Av. aspect ratio 3.0 | 0.20 | 16 | 4.3 | Quadruple structure | 2.8 | ○ | | | | ○ | |
| F3 | Monodisperse (111) tabular grains Av. aspect ratio 3.0 | 0.23 | 16 | 4.3 | Triple structure | 2.9 | | ○ | ○ | | ○ | |
| G3 | Monodisperse (111) tabular grains Av. aspect ratio 4.0 | 0.25 | 12 | 3.5 | Triple structure | | ○ | ○ | | | ○ | |
| H3 | Monodisperse (111) tabular grains Av. aspect ratio 5.0 | 0.30 | 15 | 2.4 | Triple structure | 0.9 | | ○ | | | | ○ |
| J3 | Monodisperse (111) tabular grains Av. aspect ratio 6.0 | 0.30 | 16 | 2.3 | Triple structure | 2.8 | ○ | | ○ | | ○ | |
| K3 | Monodisperse (111) tabular grains Av. aspect ratio 8.0 | 0.37 | 11 | 3.8 | Quadruple structure | 2.5 | | ○ | | | | ○ |
| L3 | Monodisperse (111) tabular grains Av. aspect ratio 5.0 | 0.46 | 17 | 3.6 | Quadruple structure | 2.7 | ○ | ○ | | | ○ | |

-continued

Table 5 Light-sensitive emulsion used in the samples (All are silver iodobromide grains)

| Emulsion | Characteristics | Av. ESD (μm) | COV (%) | Av. AgI content (mol %) | Structure in halide composition of silver halide grains | Average AgI content at grain surface (mol %) | Other characteristics (1) | (2) | (3) | (4) | (5) | (6) |
|---|---|---|---|---|---|---|---|---|---|---|---|---|
| M3 | Monodisperse (111) tabular grains Av. aspect ratio 8.0 | 0.55 | 14 | 2.3 | Quintuple structure | 1.8 | ○ | ○ | | ○ | ○ | |

Av. ESD = Equivalent sphere average grain diameter;
COV = Coefficient of variation
(Other characteristics)
The mark "○" means each of the conditions set forth below is satisfied.
(1) to (6) are as mentioned above in Table 3.

TABLE 6

Spectral sensitization of emulsions A3-M3

| Emulsion | Spectral sensitizing dye added | Addition amount per mol of silver halide (g) | Timing at which the sensitizing dye was added |
|---|---|---|---|
| A3 | S-1 | 0.050 | Immediately after chemical sensitization |
| | S-2 | 0.50 | " |
| B3 | S-1 | 0.03 | Immediately after completion of grain formation |
| | S-2 | 0.60 | Immediately after completion of grain formation |
| C3 | S-1 | 0.06 | During grain formation |
| | S-2 | 0.50 | " |
| E3 | S-3 | 0.7 | Immediately after chemical sensitization |
| | S-4 | 0.2 | " |
| F3 | S-3 | 0.5 | Immediately after chemical sensitization |
| | S-4 | 0.15 | " |
| G3 | S-3 | 0.50 | Immediately after completion of grain formation |
| | S-4 | 0.15 | Immediately after completion of grain formation |
| H3 | S-3 | 0.4 | During grain formation |
| | S-4 | 0.15 | " |
| J3 | S-6 | 0.4 | Immediately before chemical sensitization |
| | S-5 | 0.1 | " |
| K3 | S-6 | 0.4 | During grain formation |
| | S-5 | 0.1 | " |
| L3 | S-6 | 0.5 | Immediately after completion of grain formation |
| | S-5 | 0.15 | Immediately after completion of grain formation |
| M3 | S-6 | 0.5 | Immediately after chemical sensitization |
| | S-5 | 0.15 | " |

TABLE 7

Spectral sensitization of emulsions A4–N4

| Emulsion | Spectral sensitizing dye added | Addition amount per mol of silver halide (g) | Timing at which the sensitizing dye was added |
|---|---|---|---|
| A4 | S-1 | 0.075 | Immediately after chemical sensitization |
| | S-2 | 0.75 | " |
| B4 | S-1 | 0.03 | Immediately after completion of grain formation |
| | S-2 | 0.75 | Immediately after completion of grain formation |
| C4 | S-1 | 0.06 | Immediately after chemical sensitization |
| | S-2 | 0.75 | " |

TABLE 7-continued

Spectral sensitization of emulsions A4–N4

| Emulsion | Spectral sensitizing dye added | Addition amount per mol of silver halide (g) | Timing at which the sensitizing dye was added |
|---|---|---|---|
| D4 | S-1 | 0.03 | Immediately after chemical sensitization |
| | S-2 | 0.30 | " |
| | S-7 | 0.03 | " |
| E4 | S-3 | 1.5 | Immediately after chemical sensitization |
| | S-4 | 0.3 | " |
| F4 | S-3 | 0.9 | Immediately after chemical sensitization |
| | S-4 | 0.3 | " |
| G4 | S-3 | 0.75 | Immediately after completion of grain formation |
| | S-4 | 0.24 | Immediately after completion of grain formation |
| H4 | S-3 | 0.6 | During grain formation |
| | S-4 | 0.18 | " |
| I4 | S-3 | 0.9 | Immediately before the initiation of chemical sensitization |
| | S-4 | 0.18 | Immediately before the initiation of chemical sensitization |
| | S-8 | 0.3 | Immediately before the initiation of chemical sensitization |
| J4 | S-6 | 0.6 | During grain formation |
| | S-5 | 0.15 | " |
| K4 | S-6 | 0.3 | During grain formation |
| | S-5 | 0.15 | " |
| L4 | S-6 | 0.66 | Immediately after completion of grain formation |
| | S-5 | 0.18 | Immediately after completion of grain formation |
| M4 | S-6 | 0.45 | Immediately after chemical sensitization |
| | S-5 | 0.16 | " |
| N4 | S-6 | 0.66 | Immediately after completion of grain formation |
| | S-5 | 0.18 | Immediately after completion of grain formation |

TABLE 8

Construction of samples

| Sample | | Replacement of emulsions A–N | Total amount of spectral sensitizing dye ($mg/m^2$) | Replacement of surfactant |
|---|---|---|---|---|
| 101 | Comparison | As described in the specification | 9.4 | |
| 102 | Comparison | Emulsions A and B are replaced with A2 and B2, respectively | 15.9 | Same as 101 |
| 103 | Comparison | Same as 101 | 9.4 | K-3 |
| 104 | Invention | Same as 102 | 15.9 | K-3 |
| 105 | Comparison | Same as 102 | 15.9 | W-2 |
| 106 | Comparison | All of emulsions A–N are replaced with A2–N2, respectively | 46.5 | Same as 101 |
| 107 | Invention | Same as 106 | 46.5 | K-3 |
| 108 | Comparison | Emulsions A and B are replaced with emulsions A3 and B3, respectively | 11.2 | Same as 101 |
| 109 | Invention | Same as 108 | 11.2 | K-3 |
| 110 | Comparison | Emulsions A, B, C, E, F, G, H, J, L and M are replaced with emulsions A3, B3, C3, E3, F3, G3, H3, J3, J3, L3 and M3, respectively | 24.0 | Same as 101 |
| 111 | Invention | Same as 110 | 24.0 | K-3 |
| 112 | Invention | Same as 106 | 46.5 | K-8 |
| 113 | Invention | Same as 106 | 46.5 | K-12 |
| 114 | Invention | Same as 106 | 46.5 | 70% of W-3 are replaced with K-15 |
| 115 | Invention | Same as 106 | 46.5 | 80% of W-3 are replaced with K-3 |
| 116 | Comparison | All of emulsions A–N are replaces with emulsions A4–N4, respectively | 27.9 | Same as 101 |

TABLE 8-continued

| Construction of samples | | | | |
|---|---|---|---|---|
| Sample | | Replacement of emulsions A–N | Total amount of spectral sensitizing dye (mg/m$^2$) | Replacement of surfactant |
| 117 | Invention | Same as 116 | 27.9 | K-8 |
| 118 | Invention | Same as 116 | 27.9 | K-15 |

(Evaluation of Sample)

(Estimation of Sensitivity)

Each of the samples 101 to 118 was exposed to white light of 4800K color temperature through an optical wedge of continuous density change and subjected to the development processing A described later. On the samples after development, the yellow, magenta and cyan densities were measured. In Example 1, regarding the exposure intensity realizing a cyan density of 0.7 as characteristic value, the logarithms of exposure intensity differences relative to that of sample 101 are listed in Table 9.

(Estimation of Residual Color)

Two sets were provided with respect to each of the samples 101 to 118. One set was exposed to white light with an intensity realizing the minimum density of each of the samples and subjected to the development processing B being the same as the following development processing A except that the temperature of second washing was 15° C.

The other set was exposed under the same conditions realizing the minimum density, and subjected to the development processing C being the same as the development processing A except that the second washing was performed at 40° C. for a prolonged period of 20 min.

Summary of the results are listed in Table 9.

(Estimation of Storability)

Two sets were provided with respect to each of the samples 101 to 118. One set was stored at 45° C. and at 80% RH for 14 days, while the other set was refrigerated for the same period. Both were exposed to white light of 4800K color temperature through an optical wedge of continuous density change and subjected to the following development processing A. On the samples after development, the yellow, magenta and cyan densities were measured. Regarding the exposure intensity realizing a cyan density of 0.7 as characteristic value, the differences between exposure intensity for samples having undergone refrigeration storage and exposure intensity for samples having undergone storage at 45° C. and at 80% RH for 14 days are listed in Table 9. Negative values indicate the sensitivity decrease by the storage at 45° C. and at 80% RH.

TABLE 9

| Result of evaluation | | | | |
|---|---|---|---|---|
| Sample | | Speed (Exposure amount to provide cyan density of 0.7; Relative value with respect to Sample 101; Logarithmic value) | Color density due to residual sensitizing dye (Difference between density of Development processing B and density of development processing C; 550 nm) | Change in speed (Exposure amount to provide cyan density of 0.7; logarithmic value) |
| 101 | Comparison | Control | 0.05 | −0.03 |
| 102 | Comparison | +0.30 | 0.13 | −0.15 |
| 103 | Comparison | 0 | 0.04 | 0 |
| 104 | Invention | +0.30 | 0.05 | 0 |
| 105 | Comparison | +0.30 | 0.13 | −0.14 |
| 106 | Comparison | +0.40 | 0.20 | −0.28 |
| 107 | Invention | +0.43 | 0.08 | −0.01 |
| 108 | Comparison | +0.15 | 0.10 | −0.08 |
| 109 | Invention | +0.16 | 0.04 | −0.01 |
| 110 | Comparison | +0.30 | 0.18 | −0.09 |
| 111 | Invention | +0.33 | 0.06 | 0 |
| 112 | Invention | +0.43 | 0.06 | 0 |
| 113 | Invention | +0.42 | 0.08 | 0 |
| 114 | Invention | +0.42 | 0.08 | −0.01 |
| 115 | Invention | +0.42 | 0.09 | −0.01 |
| 116 | Comparison | +0.05 | 0.18 | −0.04 |
| 117 | Invention | +0.05 | 0.05 | 0 |
| 118 | Invention | +0.05 | 0.06 | −0.01 |

The densities (550 nm) of both were measured, and the difference therebetween was defined as characteristic value. The greater the value, the unfavorably greater the residue of sensitizing dye brought about by the development processing B.

As compared with the sample 101, the samples 102 and 106 wherein the light-sensitive emulsion was replaced with one having an average aspect ratio of 8 or greater, although having exhibited a sensitivity increase, suffered an increase of sensitizing dye residue. By contrast, the samples 104 and 107 wherein the surfactants of the present invention were employed realized a striking reduction of sensitizing dye residue. This was a surprising result even in comparison with the sample 105 wherein use was made of the surfactant of similar structure but having shorter alkyl chain.

Similarly, although as compared with the sample 101, the samples 108 and 110 wherein the grains were replaced with those having an average equivalent sphere diameter of 0.55 μm or less and having an average aspect ratio of 2 or greater suffered a deterioration of sensitizing dye residue, the samples 109 and 111 wherein the surfactants of the present invention were employed realized a striking reduction of sensitizing dye residue.

Further, although the sample 116 wherein without changing of the configuration of silver halide grains only the amount of sensitizing dye was increased also suffered a deterioration of sensitizing dye residue, the samples 117 and 118 wherein the surfactants of the present invention were employed realized a striking improvement.

Although all the comparative samples posed such a problem that a sensitivity decrease was caused by sample storage at high temperature, the problem of sensitivity decrease was substantially completely solved by the replacement of the surfactant with those within the scope of the present invention.

The effects of reduction of sensitizing dye residue and enhancement of storability of photosensitive material realized by the use of the surfactant of the present invention were unknown and unexpected.

The development processing A refers to the following development processing operation.

In the estimation, unexposed samples 101 and 105 and those completely exposed having been subjected to, at a ratio of 1:1, running processing until the replenisher volume became 4 times the tank capacity were used.

| Step | Time (min) | Temp. (° C.) | Tank vol. (L) | Replenishment rate (mL/m$^2$) |
|---|---|---|---|---|
| 1st Development | 6 | 38 | 60 | 2200 |
| 1st Aater washing | 2 | 38 | 20 | 7500 |
| Reversal | 2 | 38 | 20 | 1100 |
| Color development | 6 | 38 | 60 | 2200 |
| Prebleaching | 2 | 38 | 20 | 1100 |
| Bleaching | 6 | 38 | 60 | 220 |
| Fixing | 4 | 38 | 40 | 1100 |
| 2nd Water washing | 4 | 40 | 40 | 7500 |
| Final rinse | 1 | 25 | 10 | 1100 |

The composition of each processing solution was as follows.

| (1st development solution) | Tank solution | Replenisher |
|---|---|---|
| Pentasodium nitrilo-N,N,N-trimethylenephosphonate | 1.5 g | 1.5 g |
| Pentasodium diethylenetriaminepentacetate | 2.0 g | 2.0 g |
| Sodium sulfite | 30 g | 30 g |
| Hydroquinone/potassium monosulfonate | 22 g | 22 g |
| Potassium carbonate | 15 g | 15 g |
| Potassium bicarbonate | 12 g | 12 g |

-continued

| (1st development solution) | Tank solution | Replenisher |
|---|---|---|
| 1-Phenyl-4-methyl-4-hydroxymethyl-3-pyrazolidone | 1.2 g | 1.5 g |
| Potassium bromide | 3.0 g | 1.4 g |
| Potassium thiocyanate | 1.2 g | 1.2 g |
| Potassium iodide | 4.0 mg | — |
| Water to make | 1000 mL | 1000 mL |
| pH | 9.65 | 9.65 |

This pH was adjusted by the use of sulfuric acid or potassium hydroxide.

| (Reversal solution) | Tank solution | Replenisher |
|---|---|---|
| Pentasodium nitrilo-N,N,N-trimethylenephosphonate | 3.0 g | same as the tank solution |
| Stannous chloride dihydrate | 1.0 g | |
| Sodium hydroxide | 8 g | |
| Glacial acetic acid | 15 mL | |
| Water to make | 1000 mL | |
| pH | 5.90 | |

This pH was adjusted by the use of acetic acid or sodium hydroxide.

| (Color developer) | Tank solution | Replenisher |
|---|---|---|
| Pentasodium nitrilo-N,N,N-trimethylenephosphonate | 2.0 g | 2.0 g |
| Sodium sulfite | 5.7 g | 7.0 g |
| Dipotassium hydrogenphosphate | 22 g | 22 g |
| Potassium bromide | 0.5 g | — |
| Potassium iodide | 30 mg | — |
| Sodium hydroxide | 14.0 g | 14.0 g |
| Citrazinic acid | 0.4 g | 0.5 g |
| N-Ethyl-N-(β-methanesulfonamidoethyl)-3-methyl-4-aminoaniline 3/2 sulfate monohydrate | 8.0 g | 10.0 g |
| 3,6-Dithiaoctane-1,8-diol | 0.6 g | 0.7 g |
| Water to make | 1000 mL | 1000 mL |
| pH | 11.90 | 12.00 |

This pH was adjusted by the use of sulfuric acid or potassium hydroxide.

| (Prebleaching) | Tank solution | Replenisher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde/sodium bisulfite adduct | 25 g | 25 g |
| Water to make | 1000 mL | 1000 mL |
| pH | 6.30 | 6.10 |

This pH was adjusted by the use of acetic acid or sodium hydroxide.

| (Bleaching solution) | Tank solution | Replenisher |
|---|---|---|
| Disodium ethylenediaminetetraacetate dihydrate | 2.0 g | 4.0 g |
| Fe(III) ammonium ethylenediaminetetraacetate dihydrate | 120 g | 240 g |
| Potassium bromide | 100 g | 200 g |
| Ammonium nitrate | 10 g | 20 g |
| Water to make | 1000 mL | 1000 mL |
| pH | 5.70 | 5.50 |

This pH was adjusted by the use of nitric acid or sodium hydroxide.

| (Fixing solution) | Tank solution | Replenisher |
|---|---|---|
| Ammonium thiosulfate | 80 g | same as the tank solution |
| Sodium sulfite | 5.0 g | |
| Sodium bisulfite | 5.0 g | |
| Water to make | 1000 mL | |
| pH | 6.60 | |

This pH was adjusted by the use of acetic acid or aqueous ammonia.

| (Stabilizer) | Tank solution | Replenisher |
|---|---|---|
| 1,2-Benzoisothiazolin-3-one | 0.02 g | 0.03 g |
| Polyoxyethylene p-monononylphenyl ether (av. deg. of polymn. 10) | 0.3 g | 0.3 g |
| Polymaleic acid (av. mol. wt. 2,000) | 0.1 g | 0.15 g |
| Water to make | 1000 mL | 1000 mL |
| pH | 7.0 | 7.0 |

Example 2

Emulsions A5 to N5 were prepared in the same manner as in the preparation of emulsions A2 to N2 except that the types of sensitizing dyes were replaced with those as set forth below. The substitution of the sensitizing dye was carried out so that the weight ratios to the amounts of the corresponding dyes before substitution were 1.4, respectively.

S-1→S-13,

S-2→S-15,

S-7→S-13,

S-3→unchanged but the same amount increase was effected,

S-4→S-16,

S-8→S-3,

S-5→S-11, and

S-6→S-12.

Samples 206, 207 and 212–214 were prepared in the same manner as in the preparation of samples 106, 107 and 112–114, respectively, except that replacement with the emulsions A5 to N5 was effected and that the following light-sensitive emulsion layers (A) and (B) were inserted between the 3rd layer and the 4th layer while the following light-sensitive emulsion layer (C) was inserted between the 13th layer and the 14th layer. The total amount of sensitizing dyes was 70.0 milligrams.

Light-sensitive Emulsion Layer (A)

| | | |
|---|---|---|
| Emulsion O | silver | 0.20 g |
| Emulsion P | silver | 0.10 g |
| Fine-grain silver iodide (cubic grains, av. equiv. sphere diam. 0.05 μm) | silver | 0.050 g |
| Gelatin | | 0.5 g |
| Compound Cpd-F | | 0.030 g |
| High-boiling organic solvent Oil-6 | | 0.010 g |
| W-3 | | 2.0 mg |

Light-sensitive Emulsion Layer (B)

| | | |
|---|---|---|
| Emulsion Q | silver | 0.20 g |
| Gelatin | | 0.4 g |

Light-sensitive Emulsion Layer (C)

| | | |
|---|---|---|
| Emulsion R | silver | 0.15 g |
| Gelatin | | 0.40 g |
| Coupler C-1 | | 5.0 mg |
| Coupler C-2 | | 0.5 mg |
| High-boiling organic solvent Oil-5 | | 2.0 mg |
| Compound Cpd-Q | | 0.20 g |
| W-3 | | 0.4 mg |

TABLE 10

Characteristics of emulsions O–R (All are silver iodobromide)

Silver iodobromide emulsions used in samples 206, 207, 212–214

| Emulsion | Characteristics | Av. ESD (μm) | COV (%) | Av. AgI content (mol %) | Structure in halide composition of silver halide grains | Average AgI content at grain surface (mol %) | Other characteristics (1) | (2) | (3) | (4) | (5) |
|---|---|---|---|---|---|---|---|---|---|---|---|
| 0 | Monodisperse (111) tabular grains Av. aspect ratio 5.0 | 0.45 | 15 | 8.0 | Quadruple structure | 4.0 | ○ | ○ | | | ○ |

TABLE 10-continued

Characteristics of emulsions O–R (All are silver iodobromide)

Silver iodobromide emulsions used in samples 206, 207, 212–214

| Emulsion | Characteristics | Av. ESD (μm) | COV (%) | Av. AgI content (mol %) | Structure in halide composition of silver halide grains | Average AgI content at grain surface (mol %) | Other characteristics (1) | (2) | (3) | (4) | (5) |
|---|---|---|---|---|---|---|---|---|---|---|---|
| P | Monodisperse (111) tabular grains Av. aspect ratio 4.0 | 0.76 | 13 | 12.5 | Quadruple structure | 3.0 | | ○ | ○ | | ○ |
| Q | Monodisperse (111) tabular grains Av. aspect ratio 4.0 | 0.45 | 13 | 10.5 | Quadruple structure | 2.8 | ○ | ○ | | | ○ |
| R | Monodisperse (111) tabular grains Av. aspect ratio 4.0 | 0.60 | 15 | 12.5 | Triple structure | 1.5 | | ○ | | | ○ |

Av. ESD = Equivalent sphere average grain diameter;
COV = Coefficient of variation
(Other characteristics)
The mark "○" means each of the conditions set forth below is satisfied.
(1) to (5) are as mentioned above in Table 3.

TABLE 11

Spectral sensitization of emulsions O–R

| Emulsion | Spectral sensitizing dye added | Addition amount per mol of silver halide (g) | Timing at which the sensitizing dye was added |
|---|---|---|---|
| O | S-9 | 0.40 | Subsequent to after-ripening |
| | S-10 | 0.30 | " |
| P | S-9 | 0.40 | Subsequent to after-ripening |
| | S-10 | 0.30 | Prior to after-ripening |
| Q | S-11 | 0.05 | Prior to after-ripening |
| | S-12 | 0.60 | " |
| R | S-13 | 0.60 | Prior to after-ripening |
| | S-14 | 0.30 | " |

These were evaluated in the same manner as in Example 1, and the following results were obtained.

TABLE 12

Evaluation results of samples 206, 207 and 212–214

| Sample | | Speed (Exposure amount to provide cyan density of 0.7; Relative value with respect to Sample 101; Logarithmic value) | Color density due to residual sensitizing dye (Difference between density of Development processing B and density of development processing C; 550 nm) | Change in speed (Exposure amount to provide cyan density of 0.7; logarithmic value) |
|---|---|---|---|---|
| 206 | Comparison | +0.55 | 0.25 | −0.30 |
| 207 | Invention | +0.60 | 0.06 | −0.02 |
| 212 | Invention | +0.60 | 0.06 | −0.01 |
| 213 | Invention | +0.58 | 0.06 | 0 |
| 214 | Invention | +0.58 | 0.07 | −0.01 |

As apparent from the above, despite changing of the type of sensitizing dye, the residue of sensitizing dyes was reduced by the use of the surfactants of the present invention.

Example 3

Samples 306 to 314 were prepared by providing a support of 97 μm thick polyethylene terephthalate (subjected to heat treatment at 70° C. for 20 hr and having its one major surface furnished with the same undercoating as in Example 1) and coating the support on the undercoated surface with the same light-sensitive emulsion layers as those of samples 206 to 214 of Example 2, respectively.

The samples 306 to 314 were evaluated in the same manner as in Examples 1 and 2. As a result, it was found that favorable results were attained by the present invention.

Example 4

Sample (designated sample 401) being a follow-up test sample of sample 101 described in Example 101 of JP-A-2003-114504 and sample (designated sample 402) being a sample as obtained by replacing 70% of W-2 and W-3 of the sample 101 with K-3 of the present invention were prepared.

With respect to each of the samples 401 and 402, two sets were provided and in unexposed form subjected to processing described in Example 101 of JP-A-2003-114504. In the processing, one set was processed at a washing temperature of 20° C., while the other set was processed at temperature held at 38° C. Density difference therebetween was measured, and it was found that the sample 402 wherein the surfactant of the present invention was employed exhibited less density difference and enabled minimum density lowering, thus giving favorable results.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photosensitive material comprising at least one light-sensitive silver halide emulsion layer on a support, wherein the silver halide photosensitive material has at least one layer comprising an emulsified dispersion containing at least one surfactant represented by general formula (I), and at least one emulsion containing tabular silver halide grains having an average aspect ratio of 8 or greater, and at least one sensitizing dye.

$$(R_1\text{-}L)_n\text{-}J\text{-}(A)_m \qquad \text{General formula (I)}$$

wherein A represents an acid group selected from the group consisting of sulfonic acid, phosphoric acid and carboxylic acid groups, or a metal salt thereof, $R_1$ represents an aliphatic group containing a linear aliphatic group having 6 or more carbon atoms as a partial structure thereof, L represents a bivalent group, J represents a linking group of n+m valence which links $R_1$-L with A, n is an integer of 1 to 6, and m is an integer of 1 to 3, provided that when n is 1, the total number of carbon atoms of $R_1$ is 17 or greater, and when n is 2 or greater, the total number of carbon atoms of all the $R_1$ is 17 or greater and the plurality of $R_1$-L's may be the same or different, that when m is 2 or greater the plurality of A's may be the same or different, and that when A is an acid group, the quotient of the molecular weight of surfactant of the general formula (I) divided by m is 430 or greater, and when A is a salt of metal atom, the molecular weight of the surfactant of the general formula (I) after substitution of the metal atom with hydrogen atom, divided by m is 430 or greater.

2. A silver halide photosensitive material comprising at least one light-sensitive silver halide emulsion layer on a support, wherein the silver halide photosensitive material has at least one layer comprising an emulsified dispersion containing a surfactant represented by general formula (I), and at least one emulsion containing tabular silver halide grains having an average equivalent sphere diameter of 0.55 $\mu$m or less and having an average aspect ratio of 2 or greater, and at least one sensitizing dye.

$$(R_1\text{-}L)_n\text{-}J\text{-}(A)_m \qquad \text{General formula (I)}$$

wherein A represents an acid group selected from the group consisting of sulfonic acid, phosphoric acid and carboxylic acid groups, or a metal salt thereof, $R_1$ represents an aliphatic group containing a linear aliphatic group having 6 or more carbon atoms as a partial structure thereof, L represents a bivalent group, J represents a linking group of n+m valence which links $R_1$-L with A, n is an integer of 1 to 6, and m is an integer of 1 to 3, provided that when n is 1, the total number of carbon atoms of $R_1$ is 17 or greater, and when n is 2 or greater, the total number of carbon atoms of all the $R_1$'s is 17 or greater and the plurality of $R_1$-L's may be the same or different, that when m is 2 or greater the plurality of A's may be the same or different, and that when A is an acid group, the quotient of the molecular weight of surfactant of the general formula (I) divided by m is 430 greater, and when A is a salt or metal atom, the molecular weight of the surfactant of the general formula (I) after substitution of the metal atom with hydrogen atom, divided by m is 430 greater.

3. A silver halide photosensitive material comprising at least one light-sensitive silver halide emulsion layer on a support, wherein the silver halide photosensitive material has at least one layer comprising an emulsified dispersion containing a surfactant represented by the following general formula (I), and a total amount of spectral sensitizing dyes contained in the silver halide photosensitive material is in the range of 18 to 200 mg/m$^2$ $$(R_1\text{-}L)_n\text{-}J\text{-}(A)_m \qquad \text{General formula (I)}$$

wherein A represents an acid group selected from the group consisting of sulfonic acid, phosphoric acid and carboxylic acid groups, or a metal salt thereof, $R_1$ represents an aliphatic group containing a linear aliphatic group having 6 or more carbon atoms as a partial structure thereof, L represents a bivalent group, J represents a linking group of n+m valence which links $R_1$-L with A, n is an integer of 1 to 6, and m is an integer of 1 to 3, provided that when n is 1, the total number of carbon atoms of $R_1$ is 17 or greater, and when n is 2 or greater, the total number of carbon atoms of all the $R_1$'s is 17 or greater and the plurality of $R_1$-L's may be the same or different, that when m is 2 or greater the plurality of A's maybe the same or different, and that when A is an acid group, the quotient of the molecular weight of the surfactant of the general formula (I) divided by m is 430 greater, and when A is a salt of metal atom, the molecular weight of surfactant of the general formula (I) after substitution of the metal atom with hydrogen atom, divided by m is 430 or greater.

4. The silver halide photosensitive material according to claim 1, wherein the surfactant represented by the general formula (I) is one represented by general formula (II):

$$(R_1\text{-}L_2)_k\text{-}J\text{-}SO_3M \qquad \text{General formula (II)}$$

wherein $R_1$ is as defined in claim 1, $L_2$ represents a bivalent group selected from —O—, —CO— and —O—CO—, wherein —O—CO— is bonded with $R_1$ at the left side thereof, k is 2 or 3, J represents a linking group of k+1 valence, provided that the J group does not contain any aryl group, and M represents a hydrogen atom or a metal atom, provided that the total number of carbon atoms of $R_1$'s in the moiety of $(R_1\text{-}L_2)_k$ is 17 or greater, and that when M is a hydrogen atom the molecular weight of surfactant of the general formula (II) is 430 greater, and when M is a metal atom the molecular weight of surfactant of the general formula (II) after substitution of the metal atom with a hydrogen atom, is 430 or more.

5. The silver halide photosensitive material according to claim 1, wherein the surfactant represented by the general formula (I) is used in an amount of at least 20% by weight of all the surfactants used in the silver halide photosensitive material.

6. The silver halide photosensitive material according to claim 1, wherein the average aspect ratio of the tabular silver halide grains is 10 or more.

7. The silver halide photosensitive material according to claim 1, wherein the weight ratio, in terms of silver, of the tabular silver halide grains is 30% or more of the total amount of silver halide grains contained in the silver halide photosensitive material.

8. The silver halide photosensitive material according to claim 1, wherein the total amount of spectral sensitizing dyes contained in the silver halide photosensitive material is 18 $mg/m^2$ to 200 $mg/m^2$.

9. The silver halide photosensitive material according to claim 1, wherein the silver halide photosensitive material further comprises, in addition to the emulsion containing tabular silver halide grains having an average aspect ratio of 8 or greater, at least one emulsion containing tabular silver halide grains having an average equivalent sphere diameter of 0.55 $\mu$m or less and having an average aspect ratio of 2 or greater, and at least one sensitizing dye.

10. The silver halide photosensitive material according to claim 9, wherein the total weight of grains, in terms of silver, of the emulsion containing tabular silver halide grains having an average aspect ratio of 8 or greater, and the emulsion containing tabular silver halide grains having an average equivalent sphere diameter of 0.55 $\mu$m or less and having an average aspect ratio of 2 or greater, is 50% or more of the total amount of silver halide grains contained in the silver halide photosensitive material.

11. The silver halide photosensitive material according to claim 2, wherein the surfactant represented by the general formula (I) is one represented by general formula (II):

$$(R_1\text{-}L_2)_k\text{-}J\text{-}SO_3M \qquad \text{General formula (II)}$$

wherein $R_1$ is as defined in claim 2, $L_2$ represents a bivalent group selected from —O—, —CO— and —O— CO—, wherein —O——CO— is bonded with $R_1$ at the left side thereof, k is 2 or 3, J represents a linking group of k+1 valence, provided that the J group does not contain any aryl group, and M represents a hydrogen atom or a metal atom, provided that the total number of carbon atoms of $R_1$'s in the moiety of $(R_1\text{-}L_2)_k$ is 17 or greater, and that when M is a hydrogen atom the molecular weight of surfactant of the general formula (II) is 430 greater, and when M is a metal atom the molecular weight of surfactant of the general formula (II) after substitution of the metal atom with a hydrogen atom, is 430 or more.

12. The silver halide photosensitive material according to claim 2, wherein the surfactant represented by the general formula (I) is used in an amount of at least 20% by weight of all the surfactants used in the silver halide photosensitive material.

13. The silver halide photosensitive material according to claim 2, wherein the average equivalent sphere diameter of the tabular silver halide grains is 0.50 $\mu$m or less.

14. The silver halide photosensitive material according to claim 2, wherein the weight ratio, in terms of silver, of the tabular silver halide grains is 30% or more of the total amount of silver halide grains contained in the silver halide photosensitive material.

15. The silver halide photosensitive material according to claim 2, wherein the total amount of spectral sensitizing dyes contained in the silver halide photosensitive material is 18 $mg/m^2$ to 200 $mg/m^2$.

16. The silver halide photosensitive material according to claim 3, wherein the surfactant represented by the general formula (I) is one represented by general formula (II):

$$(R_1\text{-}L_2)_k\text{-}J\text{-}SO_3M \qquad \text{General formula (II)}$$

wherein $R_1$ is as defined in claim 3, $L_2$ represents a bivalent group selected from —O—, —CO— and —O—CO—, wherein —O—CO— is bonded with $R_1$ at the left side thereof, k is 2 or 3, J represents a linking group of k+1 valence, provided that the J group does not contain any aryl group, and M represents a hydrogen atom or a metal atom, provided that the total number of carbon atoms of $R_1$'s in the moiety of $(R_1\text{-}L_2)_k$ is 17 or greater, and that when M is a hydrogen atom the molecular weight of surfactant of the general formula (II) is 430 greater, and when M is a metal atom the molecular weight of surfactant of the general formula (II) after substitution of the metal atom with a hydrogen atom, is 430 or more.

17. The silver halide photosensitive material according to claim 3, wherein the surfactant represented by the general formula (I) is used in an amount of at least 20% by weight of all the surfactants used in the silver halide photosensitive material.

18. The silver halide photosensitive material according to claim 3, wherein the total amount of spectral sensitizing dyes contained in the silver halide photosensitive material is 20 $mg/m^2$ to 80 $mg/m^2$.

* * * * *